US006802257B2

(12) United States Patent
Tobe et al.

(10) Patent No.: US 6,802,257 B2
(45) Date of Patent: Oct. 12, 2004

(54) PLATE INSERTING APPARATUS

(75) Inventors: Kenji Tobe, Chiba (JP); Shinichi Fujishiro, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/644,208

(22) Filed: Aug. 19, 2003

(65) Prior Publication Data

US 2004/0168600 A1 Sep. 2, 2004

(30) Foreign Application Priority Data

Aug. 20, 2002 (JP) ..... 2002/239591

(51) Int. Cl.[7] ..... B41L 47/14; B65H 9/04

(52) U.S. Cl. ..... 101/477; 101/481; 101/480; 271/248

(58) Field of Search ..... 101/477, 479, 101/480, 481, 485, 486, DIG. 36; 271/240, 248, 250, 253

(56) References Cited

U.S. PATENT DOCUMENTS

| | | | | |
|---|---|---|---|---|
| 5,176,081 A | | 1/1993 | Buus | |
| 5,595,119 A | | 1/1997 | Hada et al. | |
| 5,806,431 A | | 9/1998 | Muth | |
| 6,712,003 B2 | * | 3/2004 | Hashiguchi | 101/477 |
| 2003/0106448 A1 | * | 6/2003 | Uemura | 101/477 |
| 2003/0188655 A1 | * | 10/2003 | Argiros et al. | 101/477 |

FOREIGN PATENT DOCUMENTS

| | | |
|---|---|---|
| DE | 43 32 803 A1 | 3/1995 |
| EP | 1 084 837 A1 | 3/2001 |
| JP | 08-108525 A | 4/1996 |
| JP | 2001-080041 A | 3/2001 |

* cited by examiner

*Primary Examiner*—Leslie J. Evanisko
(74) *Attorney, Agent, or Firm*—Blakely Sokoloff Taylor & Zafman

(57) ABSTRACT

A plate inserting apparatus includes a loader, a first regulating member, a second regulating member, and support plates, oscillating rollers, air cylinders, a shaft, and bars. The loader holds a new plate inserted in a lateral direction and feeds the new plate to a plate cylinder. The first regulating member regulates a position of one side edge of the new plate inserted in the loader. The second regulating member regulates a position of the other side edge of the new plate inserted in the loader, thus positioning the new plate in a widthwise direction in cooperation with the first regulating member. The support plates, oscillating rollers, air cylinders, shaft, and bars move the new plate inserted in the loader in a direction substantially perpendicular to a plate surface, thus accommodating the new plate between the first and second regulating members.

15 Claims, 22 Drawing Sheets

PLATE INSERTING APPARATUS

BACKGROUND OF THE INVENTION

The present invention relates to a plate inserting apparatus for inserting a new plate into the plate cylinder of a printing press.

A plate inserting apparatus of this type is disclosed in Japanese Patent Laid-Open No. 2001-80041. The plate inserting apparatus disclosed in this reference has a plate holding device for holding a new plate to be fed to a plate cylinder, and a guide device for positioning the new plate fed from the plate holding device and guiding it to the plate cylinder. In the conventional plate inserting apparatus, after the plate holding device moves by a swing motion to a plate feed position where the new plate can be fed to the plate cylinder, the guide device moves to a guide position by a swing motion, and the new plate is fed to the plate cylinder through the guide device.

In the conventional plate inserting apparatus described above, the guide device for positioning the new plate before inserting it to the plate cylinder is provided separately of the plate holding device, and the guide device is provided between the plate holding device and plate cylinder. When mounting the new plate on the plate cylinder, the new plate must be positioned at a plate inserting position by driving the guide device and plate holding device separately. Consequently, the number of air cylinders and the like serving as the driving sources increases. This increases the manufacturing cost, and interferes with downsizing of the entire apparatus.

When the plate becomes large, the diameter of the plate cylinder in the printing unit does not increase in proportion to the size increase of the plate, and the outer shape of the inking device or the like does not increase. Hence, the outer shape of the printing unit itself does not increase. Therefore, in the conventional plate inserting apparatus, when the plate becomes large, the space for installing the guide device runs short, and the plate size increase cannot be coped with.

SUMMARY OF THE INVENTION

It is an object of the present invention to provide a plate inserting apparatus that is downsized.

It is another object of the present invention to provide a plate inserting apparatus that can cope with an increase in size of a plate.

In order to achieve the above objects, according to the present invention, there is provided a plate inserting apparatus comprising a loader for holding a new plate inserted in a lateral direction and feeding the new plate to a plate cylinder, a first regulating member for regulating a position of one side edge of the new plate inserted in the loader, a second regulating member for regulating a position of the other side edge of the new plate inserted in the loader, thus positioning the new plate in a widthwise direction in cooperation with the first regulating member, and first moving means for moving the new plate inserted in the loader in a direction substantially perpendicular to a plate surface, thus accommodating the new plate between the first and second regulating members.

DESCRIPTION OF THE PREFERRED EMBODIMENTS

A plate exchanging apparatus according to an embodiment of the present invention will be described with reference to FIGS. 1 to 18. In this embodiment, a case wherein the plate changing apparatus is applied to a perfector will be described.

Figure 1:
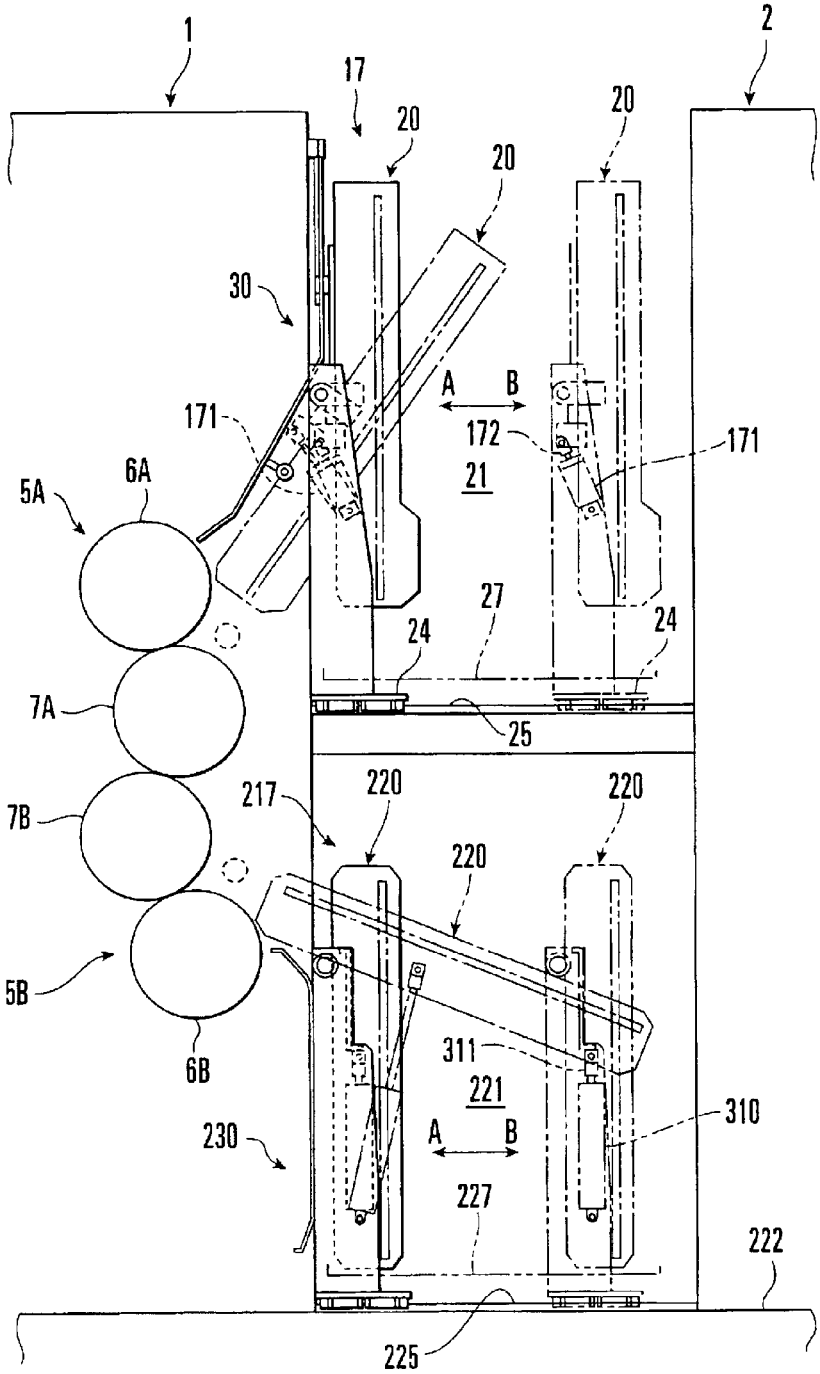
FIG. 1 is a view showing the schematic arrangement of a plate changing apparatus for a perfector according to one embodiment of the present invention.
Figure 2:
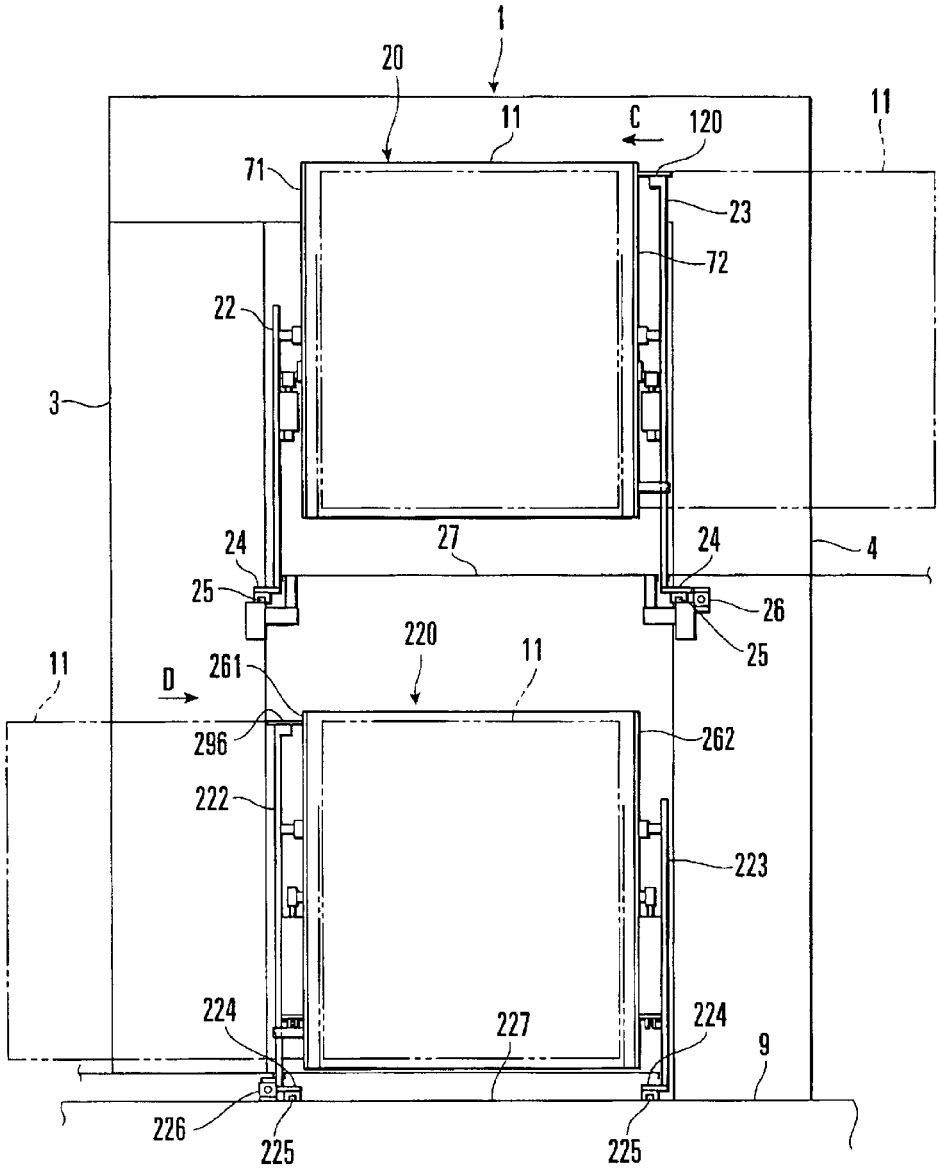
FIG. 2 is a front view of the plate changing apparatus shown in FIG. 1.

Referring to FIGS. 1 and 2, an upper printing section 5A for printing on the obverse surface of a printing product and a lower printing section 5B for printing on the reverse surface of the printing product are provided inside a pair of opposing frames 3 and 4 of a printing unit 1. The upper printing section 5A has an upper plate cylinder 6A with an outer surface where a plate is to be mounted, and an upper blanket cylinder 7A for coming into contact opposite to the upper plate cylinder 6A. The lower printing section 5B has a lower plate cylinder 6B with an outer surface where the plate is to be mounted, and a lower blanket cylinder 7B for coming into contact opposite to the lower plate cylinder 6B. The blanket cylinders 7A and 7B are arranged in contact opposite to each other, and a printing target object such as a web passes between them.

When ink and dampening water are supplied to the plate cylinders 6A and 6B from an ink supply device (not shown) and dampening device (not shown), respectively, ink portions corresponding to the patterns of the plates mounted on the plate cylinders 6A and 6B are transferred to the blanket cylinders 7A and 7B, respectively. When the printing target object passes between the blanket cylinders 7A and 7B, the patterns are printed on its two surfaces.

The upper printing section 5A further has an upper plate changing device 17 which removes an old plate mounted on the upper plate cylinder 6A and feeds a new plate to the upper plate cylinder 6A. The lower printing section 5B further has a lower plate changing device 217 which removes the old plate mounted on the lower plate cylinder 6B and feeds the new plate to the lower plate cylinder 6B.

<Upper Plate Changing i

The upper plate changing device 17 is constituted by an upper removed plate recovery section 30 which is fixed to the frames 3 and 4, and an upper loader 20 which guides the old plate removed from the upper plate cylinder 6A to the upper removed plate recovery section 30 and feeds the new plate to the upper plate cylinder 6A.

As shown in FIG. 1, the upper loader 20 is supported by the pair of outer frames 22 and 23 (FIG. 2) such that it can swing between a wait position (position indicated by a solid line in FIG. 1) where it is substantially perpendicular to the web convey direction (direction of arrows A–B) and a plate feed position (position indicated by an alternate long and short dashed line in FIG. 1) where it inclines from the wait position to move its lower end close to the outer surface of the upper plate cylinder 6A, so that the new plate in the upper loader 20 can be fed to the upper plate cylinder 6A. The outer frames 22 and 23 are vertically upright on a pair of bases 24 to oppose each other.

A pair of rails 25 extending in the direction of the arrows A–B are fixed to the frames 3 and 4, respectively, and the bases 24 are supported on the rails 25 to be movable in the direction of the arrows A–B. The bases 24 are moved in the direction of the arrows A–B by a rodless first air cylinder 26 fixed to the frame 4 and extending in the direction of arrows A–B.

When the bases 24 move, the upper loader 20 can move upright in a work space 21 provided between the printing unit 1 and an adjacent printing unit 2 from the wait position indicated by the solid line in FIG. 1 to a retreat position indicated by an alternate long and two short dashed line. A step 27 horizontally fixed to the left and right frames 3 and 4 through support members is provided under the work space 21.

<Upper Removed Plate Recovery Section>

Figure 3:
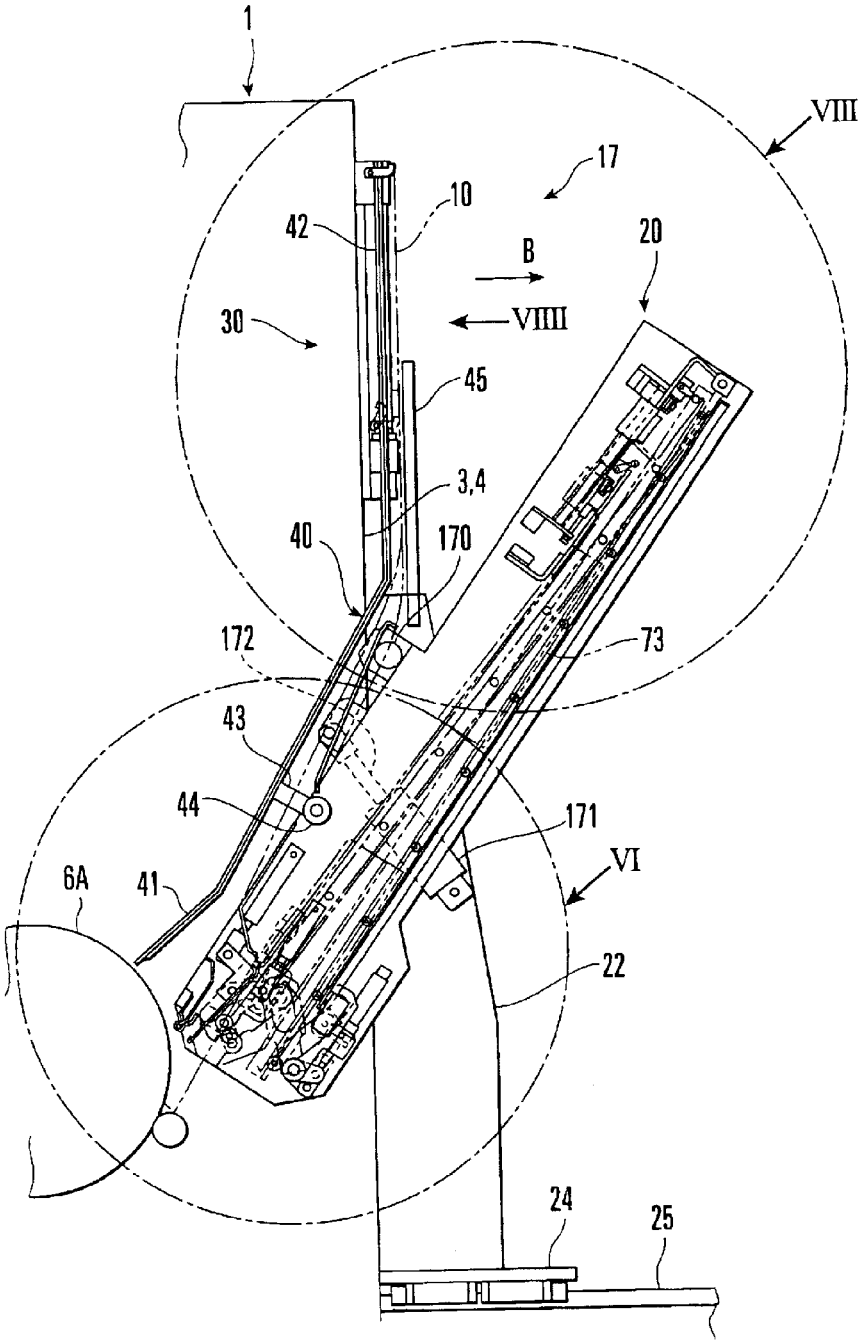
FIG. 3 is a view showing the schematic arrangement of an upper plate changing device in the plate changing apparatus shown in FIG. 1.

As shown in FIG. 3, the upper removed plate recovery section 30 has a flat removed plate guide board 40 fixed between the frames 3 and 4. The removed plate guide board 40 is formed of a lower inclined portion 41 and an upper upright portion 42 continuous to the inclined portion 41. The inclined portion 41 inclines at an angle almost equal to the angle of inclination of the upper loader 20 as it is located at the plate feed position, and its lower end comes into contact opposite to the outer surface of the upper plate cylinder 6A. The upright portion 42 is substantially vertical along the front surface of the printing unit 1.

A guide rod 43 extending between the frames 3 and 4 and having a U shape when seen from above is fixed to the inclined portion 41. The guide rod 43 has a large number of rotatable guide rollers 44 at a gap from the surface of the inclined portion 41. A pair of removal preventive members 45 (only one is shown) are so fixed to the outer frames 22 and 23 as to oppose the two ends in the horizontal direction of the upright portion 42 of the removed plate guide board 40.

In this arrangement, the old plate 10 removed from the upper plate cylinder 6A is guided between the guide rollers 44 and the upright portion 42 of the removed plate guide board 40 to move upward, and is subsequently guided by the upright portion 42 and removal preventive members 45 to be recovered by the upper removed plate recovery section 30. The old plate 10 recovered by the upper removed plate recovery section 30 is removed in the direction of an arrow B in FIG. 3.

<First Old Plate Extracting Mechanism>

Figure 8:
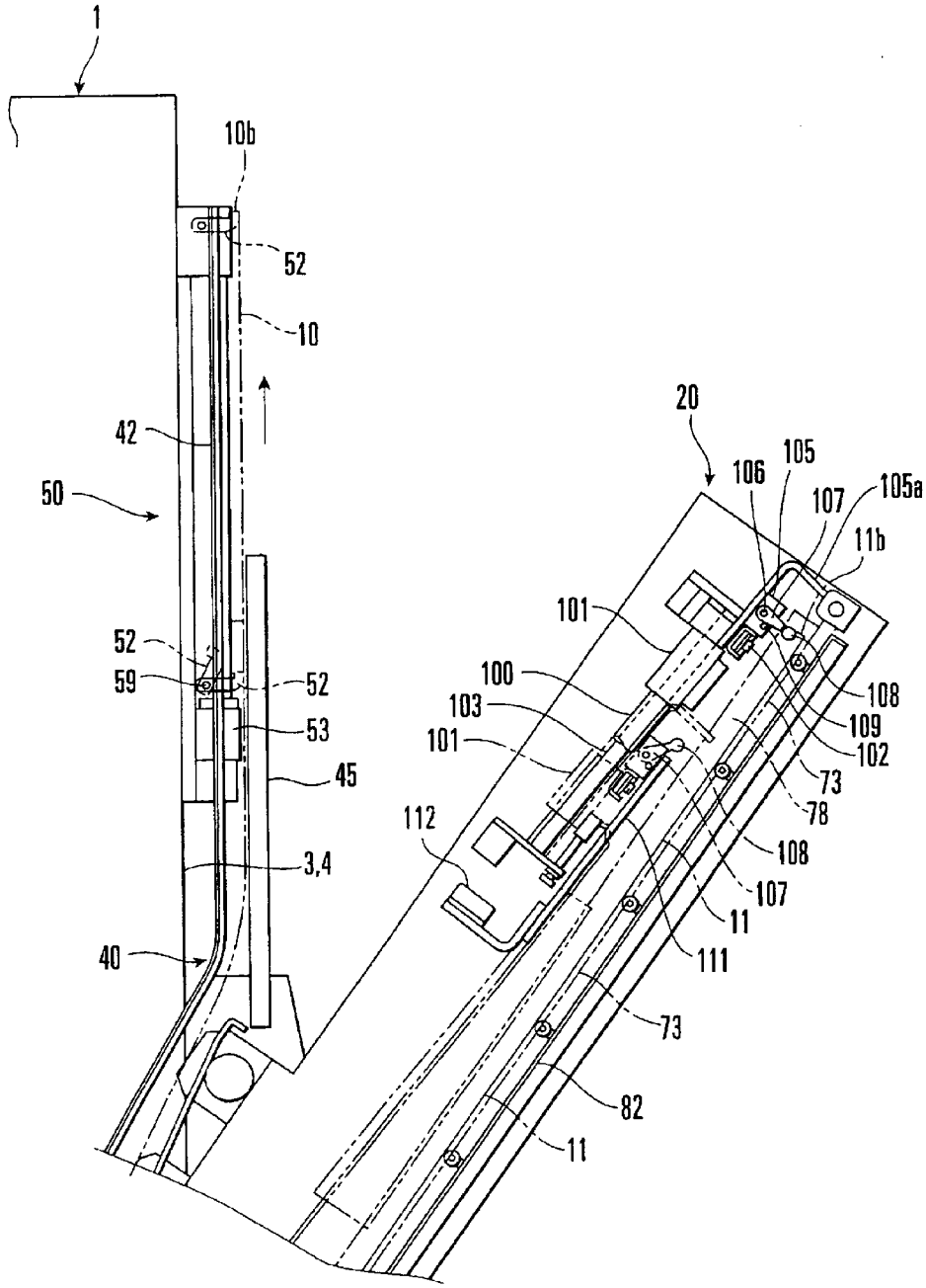
FIG. 8 is an enlarged view of the portion VIII of FIG. 3.

As shown in FIG. 8, the upright portion 42 of the removed plate guide board 40 has a first old plate extracting mechanism 50. The first old plate extracting mechanism 50 is schematically constituted by a pair of rodless second air cylinders 51 (FIG. 9) serving as the driving sources, and a hook 52 for engaging with the bent portion of a trailing edge 10*b* of an old plate 10 removed from the upper plate cylinder 6A.

Figure 9:
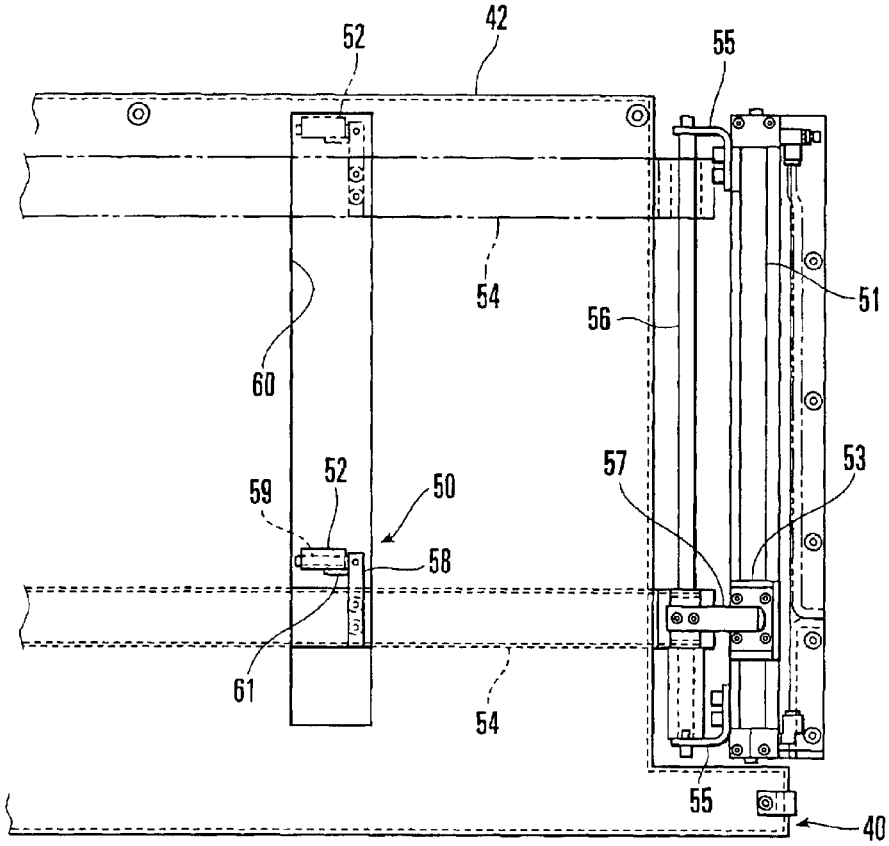
FIG. 9 is a view seen from the direction of an arrow IX of FIG. 3.

As shown in FIG. 9, the air cylinders 51 extend vertically and are fixed to the frames 3 and 4 (only one is shown), respectively, and movable elements 53 move on them vertically. A connecting member 54 extending between the frames 3 and 4 is vertically movably supported by guide pins 56 respectively fixed to the air cylinders 51 through brackets 55. When the movable elements 53 move, the connecting member 54 moves integrally with it vertically through connecting elements 57 standing upward from the movable elements 53.

A support member 58 is attached to the connecting member 54, and the proximal end of the hook 52 is pivotally supported by a shaft 59 standing upward from the support member 58. As shown in FIG. 8, the hook 52 moves forward between the upright portion 42 and the removal preventive members 45 from a notch 60 of the upright portion 42 by its weight. A stopper pin 61 standing upward from the support member 58 engages with the hook 52 moving forward between the upright portion 42 and removal preventive members 45 to hold its forward state.

In this arrangement, when the removed old plate 10 is guided to between the upright portion 42 and removal preventive members 45, the bent portion of the trailing edge 10*b* abuts against the hook 52. At this time, the hook 52 pivots about the shaft 59 as the center against Its weight, to temporarily retreat from between the upright portion 42 and removal preventive members 45. When the old plate 10 moves further upward, the hook 52 and the bent portion of the trailing edge 10*b* are disconnected from each other, and the hook 52 moves forward again to between the upright portion 42 and removal preventive members 45 by its weight.

In this state, when the movable elements 53 of the air cylinders 51 move upward, the hook 52 moves upward. As the hook 52 moves upward, it engages with the lower surface of the bent portion of the trailing edge 10*b* of the old plate 10, to pull the old plate 10 upward. According to this embodiment, the hook 52 moves forward to between the upright portion 42 and removal preventive members 45 by its weight. Hence, no driving source is necessary for moving the hook 52, so that the structure can be simplified and downsized.

<Upper Loader>

Figure 4:
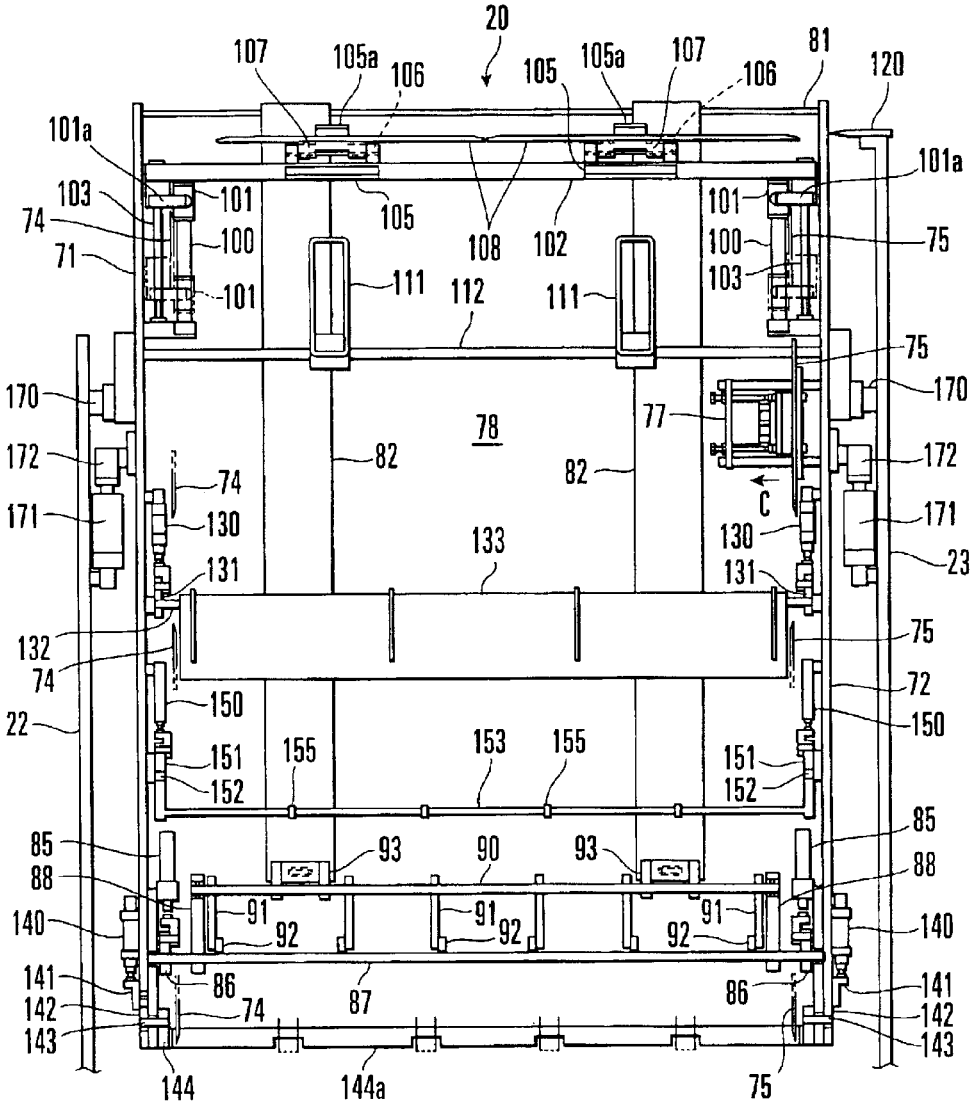
FIG. 4 is an exploded front view of an upper loader forming the upper plate changing device shown in FIG. 3.
Figure 5A:
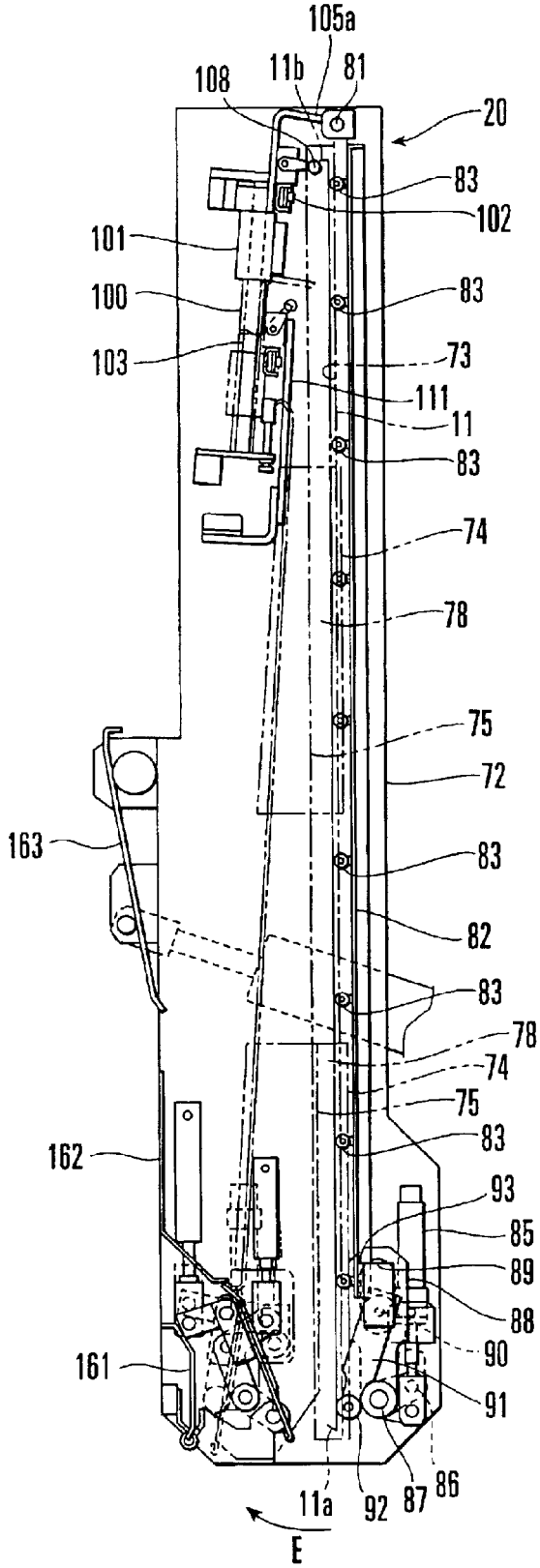
FIG. 5A is a view showing the schematic arrangement of the upper loader shown in FIG. 3, and FIGS. 5B and 5C are views showing the shapes of first and second upper regulating members, respectively.

As shown in FIG. 4, the upper loader 20 has a pair of inner frames 71 and 72 opposing each other at a gap larger than the width of the new plate 11. As shown in FIG. 5A, the inner frame 72 has a slit-like elongated hole 73 formed along its longitudinal direction so that the new plate 11 can be inserted from the side surface of the upper loader 20. As shown in FIG. 4, a flat plate-like first regulating member 74 is fixed inside the inner frame 71 to be parallel with the inner frame 71. One side edge of a new plate 11 inserted from the elongated hole 73 abuts against the first regulating member 74.

Figure 5B:
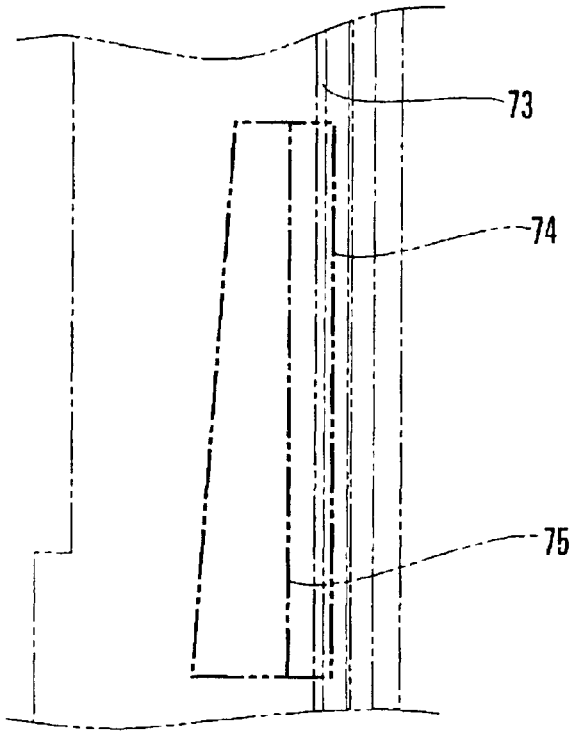
Figure 5C:
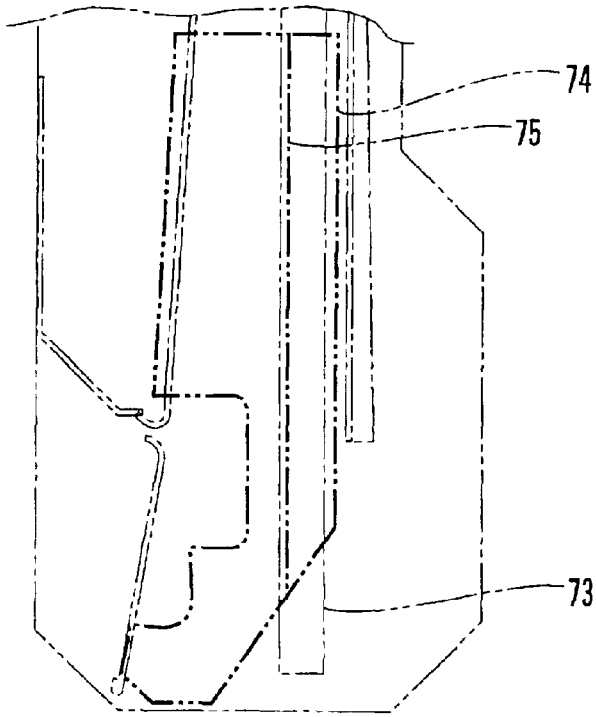

A flat plate-like second regulating member 75 opposing the first regulating member 74 is provided inside the inner frame 72. The second regulating member 75 is smaller than the first regulating member 74 by the elongated hole 73, as shown in FIGS. 5B and 5C, such that it will not regulate insertion of the new plate 11 inserted from the elongated hole 73. More specifically, the first regulating member 74 has a shape overlapping the elongated hole 73 such that one side edge of the new plate 11 abuts against the first regulating member 74 when inserting the plate. The second regulating member 75 has a size smaller than that of the first regulating member 74 by a size corresponding to the width of the elongated hole 73, so that one side edge of the new plate 11 will not abut against the second regulating member 75 when inserting the plate.

The second regulating member 75 is supported by the inner frame 72 to be movable in directions to come close to and separate from the first regulating member 74. The second regulating member 75 is moved by a third air cylinder 77 (FIG. 4), fixed to the inner frame 72, toward the first regulating member 74 slightly from the initial position (the direction of an arrow C in FIG. 4). Each of the first and second regulating members 74 and 75 is divided into upper and lower regulating members, only part of which is shown in FIG. 4.

In this arrangement, the new plate 11 inserted from the elongated hole 73 abuts against the first regulating member 74 with its one side edge, is moved by an oscillating mechanism (to be described later) in a direction perpendicular to a direction toward the surface of the new plate 11, and is accommodated loosely in a plate accommodating section 78 formed between the two regulating members 74 and 75. Subsequently, the air cylinder 77 moves the second regulating member 75 toward the first regulating member 74, so the two regulating members 74 and 75 position the new plate 11 in the widthwise direction.

Alternatively, the new plate 11 can be positioned in the widthwise direction by tapering the inner side surface of the second regulating member 75, i.e., that surface of the second regulating member 75 against which the other side edge of the new plate 11 abuts. In this case, the second regulating member 75 need not be moved. If the new plate 11 can be accommodated between the two regulating members 74 and 75 by only the operation of the oscillating mechanism, the gap between the two regulating members 74 and 75 may be set equal to the length in the widthwise direction of the new plate 11. In this case, the second regulating member 75 need not be moved, or the inner side surface of the second regulating member 75 need not be tapered.

<Upper Oscillating Mechanism>

A shaft 81 horizontally extends between the upper ends of the inner frames 71 and 72, as shown in FIG. 4. A pair of thin elongated rectangular support plates 82 have upper ends pivotally supported by the shaft 81, and lower ends extending to near the lower end of the upper loader 20. As shown in FIG. 5A, the support plates 82 have a large number of oscillating rollers 83 that come into contact with the new plate 11 inserted from the elongated hole 73 and supported by bars 108.

As shown in FIG. 4, a pair of fourth air cylinders 85 are fixed inside the inner frames 71 and 72. One end of each lever 86 is pivotally mounted on the cylinder rod end of the corresponding fourth air cylinder 85, as shown in FIG. 5A. The other end of each lever 86 is fixed to a shaft 87 rotatably supported between the inner frames 71 and 72. Thus, the shaft 87 pivots clockwise and counterclockwise in accordance with the forward and backward movement of the rods of the fourth air cylinders 85.

The proximal ends of a pair of levers 88 are fixed to the shaft 87, and elongated holes 89 are formed in the pivoting portions of the levers 88. A shaft 90 extending between the inner frames 71 and 72 is rotatably supported between the elongated holes 89 through bearings. One end of each of a plurality of levers 91 is fixed to the shaft 90, and the other end of each lever 91 rotatably supports a corresponding one of press rollers 92. The lower ends of the support plates 82 are fixed to the shaft 90 through plates 93.

Figure 6:
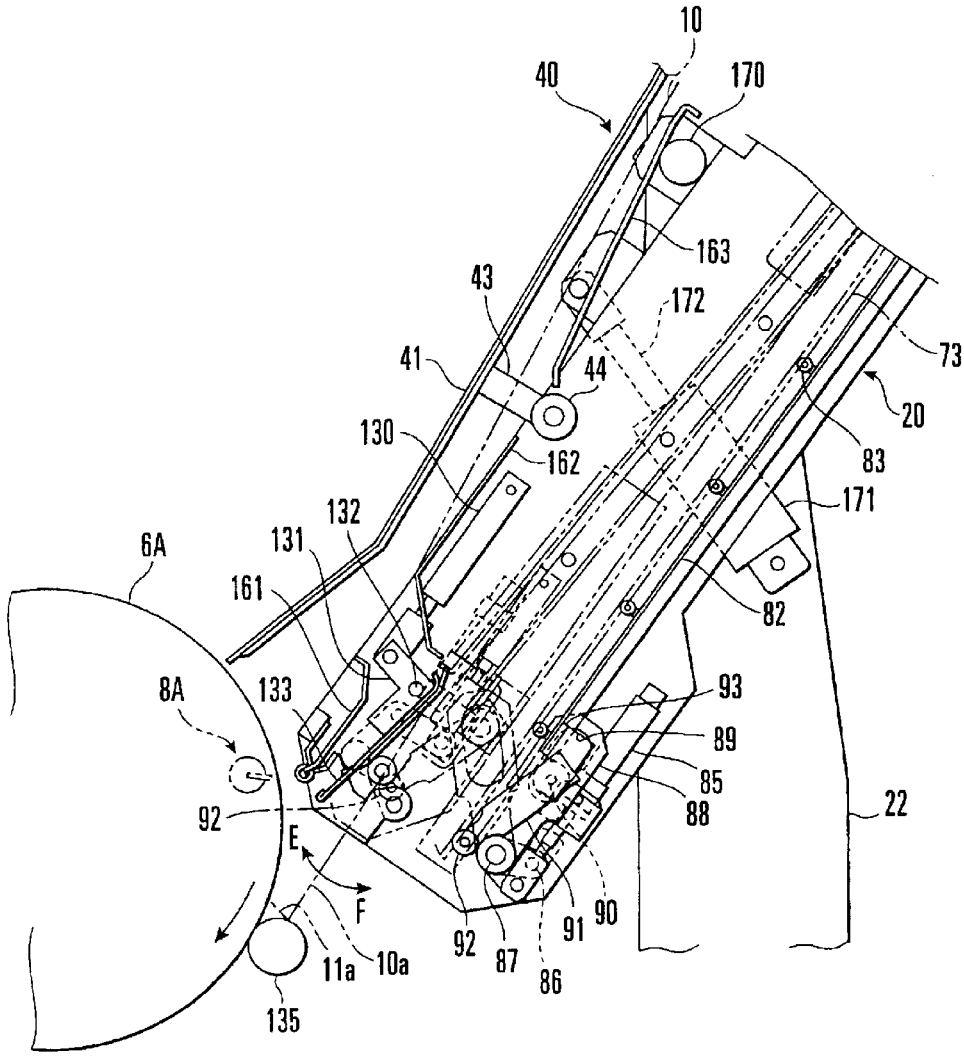
FIG. 6 is an enlarged view showing the distal end portion of the upper loader shown in FIG. 3.

In this arrangement, when the rods of the fourth air cylinders 85 move backward, the shaft 87 pivots counterclockwise in FIG. 6, so the levers 88 pivot counterclockwise about the shaft 87 as the center integrally with the shaft 87. When the levers 88 pivot, the support plates 82 pivot clockwise in FIG. 5A, so the oscillating rollers 83 also move in the direction of an arrow E. Thus, the new plate 11 is supported by the rollers 83 serving as the oscillating mechanism (member) and is accommodated between the two regulating members 74 and 75, as described above.

When the lower ends of the support plates 82 move in the direction of the arrow E, the levers 91 also move in the direction of the arrow E through the shaft 90. Accordingly, the press rollers 92 press a leading edge 11*a* of the new plate 11 in the direction of the arrow E, to position the new plate 11 with respect to a plate gripper 8A of the upper plate cylinder 6A.

<New Plate Support Mechanism>

A pair of rodless fifth air cylinders 100 are fixed inside the inner frames 71 and 72, as shown in FIG. 4. The fifth air cylinders 100 drive movable elements 101 to move vertically. The two ends of a movable rod 102 extending between the inner frames 71 and 72 are connected to the movable elements 101 through connecting elements 110*a*. When the movable elements 101 move, the movable rod 102 moves upward integrally as it is guided by a pair of guide rods 103.

A pair of bases 105 are fixed to the movable rod 102 to be separate from each other by a predetermined distance, and press portions 105*a* having inverted-L-shaped sections are fixed to the bases 105, as shown in FIG. 8. Support members 107 are rotatably supported by shafts 106 horizontally extending on the bases 105, respectively, and a pair of bars 108 horizontally, continuously extending between the inner frames 71 and 72 are fixed to the support members 107, as shown in FIG. 4.

As shown in FIG. 8, stopper pins 109 to engage with the support members 107 stand upward from the bases 105, respectively. The stopper pins 109 regulate the downward pivot motions of the respective support members 107 by their weights, so that the support members 107 are held in substantially the horizontal state, i.e., in a state of having moved forward into the plate accommodating section 78. Square-ring-like locking members 111 extend vertically on a rod 112 horizontally extending between the inner frames 71 and 72, to correspond to the support members 107, as shown in FIG. 4.

In this arrangement, when the movable elements 101 of the air cylinders 100 move downward and the support members 107 also move downward, the leading edge 11*a* of the new plate 11 supported by the bars 108 abuts against the upper plate cylinder 6A and a plate holding roller 135. Subsequently, when the support members 107 abut against the upper ends of the locking members 111 and move further downward, they pivot counterclockwise about the shafts 106 as the center against their weights, as shown in FIG. 8.

Figure 21A:
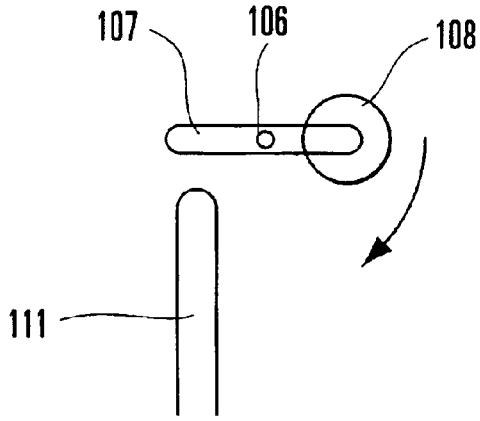
FIGS. 21A and 21B are views showing another method of disengaging the bar and the bent portion of the new plate shown in FIG. 8.
Figure 21B:
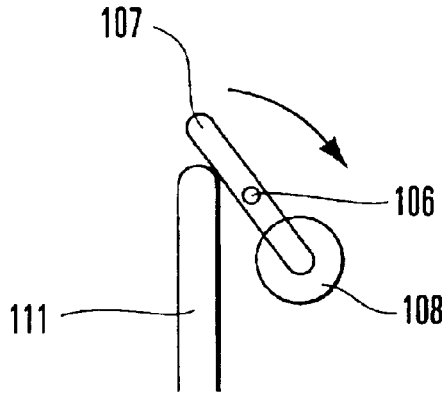

The support members 107 pivot counterclockwise about the shafts 106 as the centers, to disengage the new plate 11 and bars 108 from each other. Alternatively, as shown in FIGS. 21A and 21B, the support members 107 may pivot clockwise to disengage the new plate 11 and bars 108 from each other. In this case, the shafts 106 may be provided closer to the new plate 11 than the support members 107.

Therefore, the bars 108 retreat from the plate accommodating section 78, and accordingly the bars 108 and the bent portion of a trailing edge 11*b* of the new plate 11 are disengaged from each other. Subsequently, the press portions 105*a* press the trailing edge 11*b* of the new plate 11, so that the leading edge 11*a* can be inserted in the upper plate cylinder 6A. In this manner, when the bars 108 and new plate 11 are to be disengaged from each other, no driving mechanism for pivoting the bars 108 is necessary. Thus, the structure is simplified.

A guide bar 120 is horizontally attached to the upper end of the outer frame 23 close to the inner frame 72 having the elongated hole 73, as shown in FIG. 4. The guide bar 120 is provided at a position slightly higher than the bars 108. Thus, when the new plate 11 is to be inserted from the elongated hole 73 into the upper loader 20, as will be described later, the bent portion of the trailing edge 11*b* of the new plate 11 is placed on the guide bar 120 temporarily, so that the bent portion of the trailing edge 11*b* is smoothly and reliably guided and supported by the bars 108.

<Plate Removal/Feed Switching Guide Board>

As shown in FIG. 4, sixth air cylinders 130 are fixed inside the inner frames 71 and 72. One end of each lever 131 is pivotally mounted on the rod end of the corresponding air cylinder 130, as shown in FIG. 6. The levers 131 are pivotally supported by shafts 132 standing upward from the inner frames 71 and 72. A plate removal/feed switching guide board 133 is attached to the other end of one lever 131 and the other end of the other lever 131.

In this arrangement, when the rods of the air cylinders 130 move backward, the plate removal/feed switching guide board 133 pivots in the direction of an arrow E about the shafts 132 as the pivot center, as indicated by a solid line in FIG. 6, so that the new plate 11 can be inserted in the upper plate cylinder 6A. When the rods of the air cylinders 130 move forward, the plate removal/feed switching guide board 133 pivots in the direction of an arrow F about the shafts 132 as the pivot center, so that the old plate 10 can be removed from the upper plate cylinder 6A.

The plate holding roller 135 moves close to and away from the outer surface of the upper plate cylinder 6A by an air cylinder (not shown). In plate feeding, when the plate holding roller 135 comes into contact opposite to the outer surface of the upper plate cylinder 6A, it inserts the bent portions of the leading edge 11*a* and trailing edge 11*b* of the new plate 11 into the plate gripper 8A of the upper plate cylinder 6A, and presses the new plate 11 to come into tight contact with the outer surface of the upper plate cylinder 6A.

<Second Old Plate Extracting Mechanism>

Figure 7A:
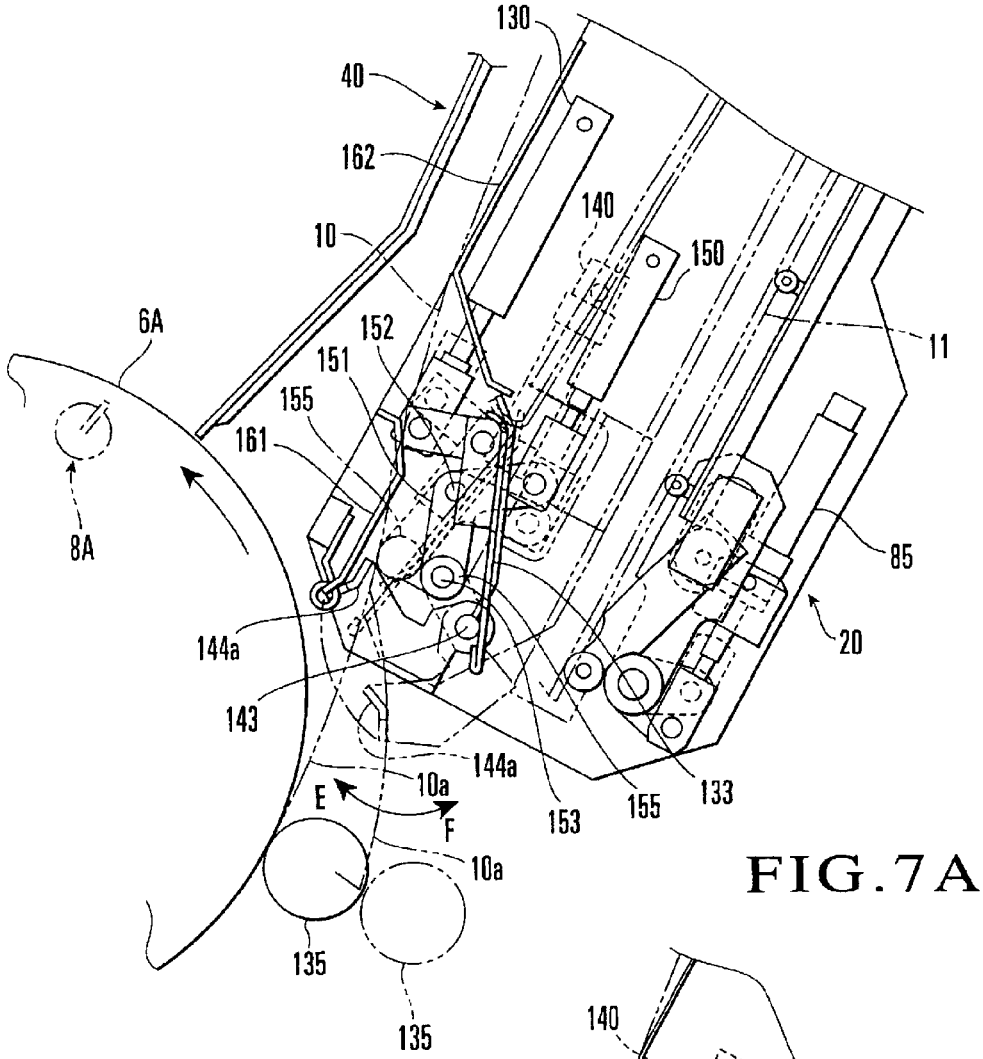
FIG. 7A is an enlarged view of the portion VI of FIG. 3 to explain the plate feed operation of the upper loader.
Figure 7B:
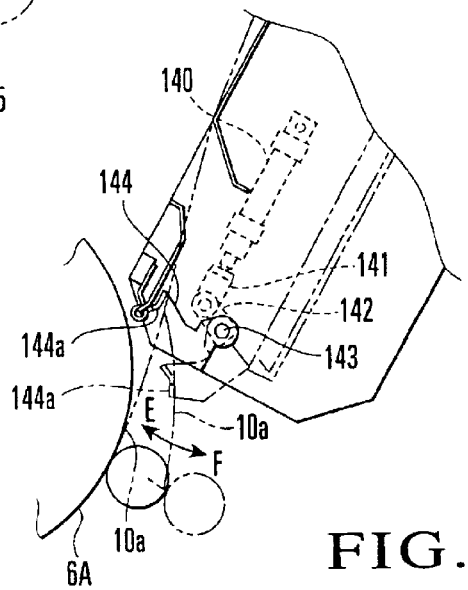
FIG. 7B is a view for explaining a second old plate extracting mechanism in detail.

As shown in FIG. 4, seventh air cylinders 140 are fixed outside the inner frames 71 and 72. As shown in FIG. 7B, one end of each lever 141 is pivotally mounted on the rod end of the corresponding air cylinder 140, and one end of a corresponding lever 142 is pivotally mounted on the other end of the lever 141. The other end of the lever 142 is axially mounted on a corresponding one of shafts 143 pivotally supported by the inner frames 71 and 72. The proximal end of a second old plate extracting lever 144 extending between the inner frames 71 and 72 is axially mounted on the shafts 143.

In this arrangement, when the rods of the air cylinders 140 move forward, the shafts 143 pivot counterclockwise in FIG. 7B through the levers 141 and 142. As the shafts 143 pivot, a swing end 144*a* of the second old plate extracting lever 144 moves in the direction of an arrow F from the position indicated by a solid line to the position indicated by an alternate long and short dashed line. Thus, the swing end 144*a* of the second old plate extracting lever 144 engages with a leading edge 10*a* of the old plate 10, and the bent portion of the leading edge 10*a* of the old plate 10 is forcibly extracted from the plate gripper 8A of the upper plate cylinder 6A.

As shown in FIG. 4, eighth air cylinders 150 having pivotally supporting cylinder ends are fixed inside the inner frames 71 and 72. One end of each lever 151 is pivotally mounted on the rod end of the corresponding air cylinder 150, as shown in FIG. 7A. The levers 151 are axially supported by the inner frames 71 and 72 to be pivotal about shafts 152 as the pivot centers, respectively, and a guide bar 153 extending between the inner frames 71 and 72 horizontally extends between the other end of one lever 151 and the other end of the other lever 151, as shown in FIG. 4. A plurality of fulcrum rollers 155 are rotatably supported by the guide bar 153.

In this arrangement, when the rods of the air cylinders 150 move forward, the levers 151 pivot clockwise about the shafts 152 as the pivot centers. As the levers 151 pivot, the fulcrum rollers 155 move in the direction of an arrow E in FIG. 7A from the position indicated by a solid line to the position indicated by an alternate long and two short dashed line. As the fulcrum rollers 155 move, they press the old plate 10 removed from the upper plate cylinder 6A toward the upper plate cylinder 6A. Thus, the old plate 10 can be reliably extracted by the second old plate extracting lever 144 described above with the fulcrum rollers 155 as the fulcrum.

As shown in FIG. 5A, three removed plate guide boards 161, 162, and 163 are fixed to the lower end of the upper loader 20 sequentially between the inner frames 71 and 72. The removed plate guide board 161 opposes the plate removal/feed switching guide board 133, and the removed plate guide boards 162 and 163 oppose the inclined portion 41 of the removed plate guide board 40 fixed to the frames 3 and 4. In this arrangement, the old plate 10 removed from the upper plate cylinder 6A passes between the removed plate guide board 161 and plate removal/feed switching guide board 133, and is guided to between the removed plate guide boards 162 and 163 and the inclined portion 41 of the removed plate guide board 40.

<Swing Motion of Upper Loader>

The upper loader 20 is swingably supported by the outer frames 22 and 23 through support shafts 170, as shown in FIG. 3. The cylinder ends of a pair of ninth air cylinders 171 having rods 172 are pivotally supported inside the outer frames 22 and 23, as shown in FIG. 4. The rod ends of the rods 172 are pivotally mounted on the inner frames 71 and 72, respectively.

In this arrangement, when the rods 172 of the air cylinders 171 move forward, the upper loader 20 inclines, and its lower end is positioned at a plate feed position close to the outer surface of the upper plate cylinder 6A, as shown in FIG. 3. When the rods 172 of the air cylinders 171 are moved backward, the upper loader 20 becomes vertical and is positioned at the wait position.

<Plate Change Operation of Upper Plate Cylinder>

Figures 10A, 10B, 10C:
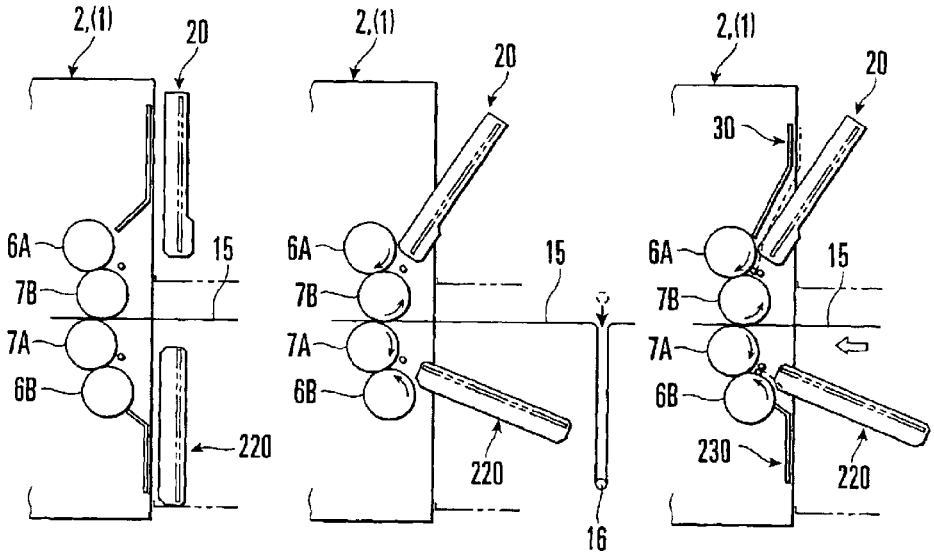
FIGS. 10A to 10E are views showing the states of the loader during plate removal and plate feeding of the plate changing apparatus shown in FIG. 1.

First, the upper loader 20 is moved from the retreat position to the wait position, as shown in FIG. 10A. More specifically, upon actuation of the air cylinder 26 (FIG. 2), the upper loader 20 moves in the direction of an arrow A from the retreat position indicated by an alternate long and two short dashed line in FIG. 1 to the wait position indicated by a solid line, to be close to the printing unit 1.

In the upper loader 20 located at the wait position, the bent portion of the trailing edge 11*b* of the new plate 11 is caught by the guide bar 120, and the new plate 11 is moved in the direction of an arrow C so that it is inserted in the upper loader 20 from the elongated hole 73 of the inner frame 72. Subsequently, the bent portion of the trailing edge 11*b* of the new plate 11 is transferred from the guide bar 120 to the bars 108 (FIG. 4), so that the new plate 11 suspends vertically by its weight and is supported by the bars 108.

Then, the rods 172 of the air cylinders 171 move forward, and accordingly the upper loader 20 inclines and is positioned at the plate feed position, as indicated by an alternate long and short dashed line in FIG. 1. In this state, the upper and lower blanket cylinders 7A and 7B are disengaged from each other, and a clutch (not shown) between the driving mechanism of the printing unit 2 and the driving mechanism of a folding machine (not shown) is disconnected. Subsequently, the driver of the printing press is driven, so that the upper and lower plate cylinders 6A and 6B rotate through almost one turn in the forward direction (clockwise in FIG. 10B), as shown in FIG. 10B.

At this time, a web 15 located between the printing unit 1 and the folding machine slacks by an amount substantially corresponding to the length of the circumference of the upper plate cylinder 6A. An air cylinder (not shown) is actuated to move a dancer roller 16 downward, thus removing the slack. Subsequently, the rods of the air cylinders 130 (FIG. 7A) move forward, so that the plate removal/feed switching guide board 133 moves in a direction of an arrow F to be positioned at the plate removal position. The plate holding roller 135 is then brought into contact opposite to the outer surface of the upper plate cylinder 6A.

Figure 19:
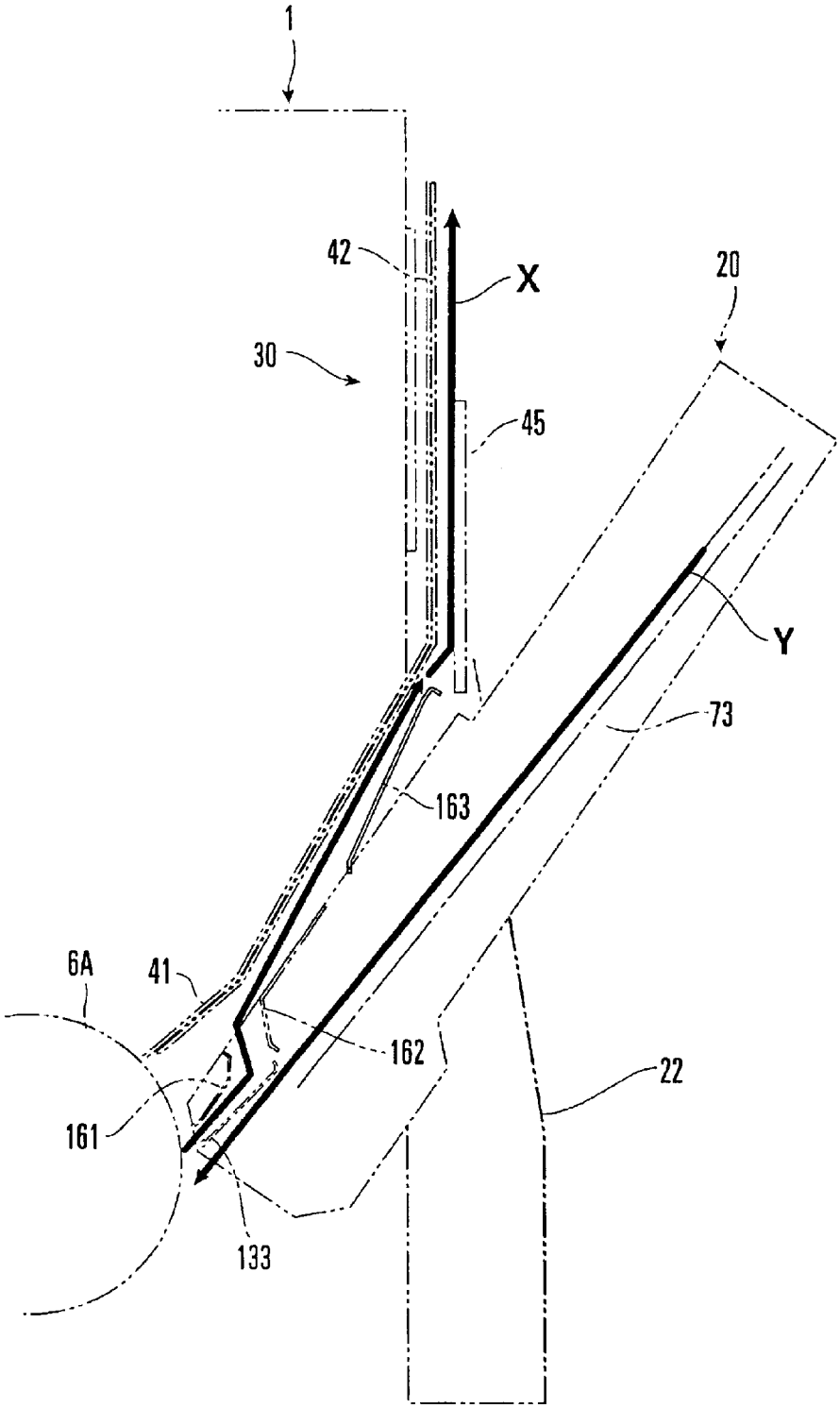
FIG. 19 is a view showing the plate removal path and plate feed path of the upper plate changing device shown in FIG. 1.
Figure 20:
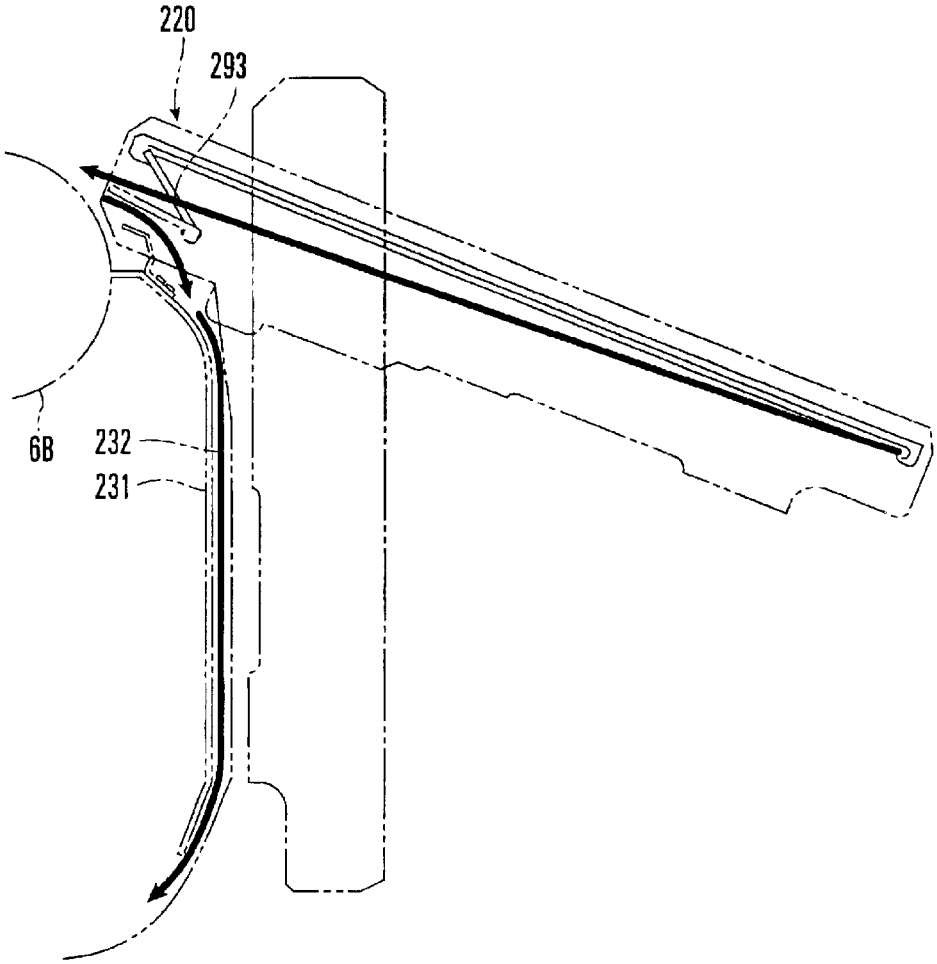
FIG. 20 is a view showing the plate removal path and plate feed path of the lower plate changing device shown in FIG. 1.

Subsequently, the reel rod of the plate gripper 8A pivots, and the trailing edge 10*b* of the old plate 10 disengages from the upper plate cylinder 6A and pops up from the outer surface of the upper plate cylinder 6A. Then, when the upper plate cylinder 6A rotates in the opposite direction (counterclockwise in FIG. 7A), the trailing edge 10*b* of the old plate 10 passes between the removed plate guide board 161 and plate removal/feed switching guide board 133, and is guided to between the removed plate guide boards 162 and 163 and the inclined portion 41 of the removed plate guide board 40. FIG. 19 shows a plate removal path X in this state.

In this manner, since the removed plate guide board 161 for guiding the old plate 10 removed from the upper plate cylinder 6A and the plate removal/feed switching guide board 133 are provided to the distal end of the upper loader 20 which comes into contact opposite to the outer surface of the upper plate cylinder 6A, the old plate 10 can be reliably guided to the upper removed plate recovery section 30 through the upper loader 20. Subsequently, the upper plate cylinder 6A rotates in the opposite direction (counterclockwise in FIG. 7A), and accordingly the trailing edge 10*b* of the old plate 10 is guided to between the upright portion 42 of the removed plate guide board 40 and the removal preventive members 45, as shown in FIG. 8.

At this time, the bent portion of the old plate 10 abuts against the hook 52, and the hook 52 temporarily retreats from between the upright portion 42 of the removed plate guide board 40 and the removal preventive members 45. Subsequently, when this abutting state is released as the bent portion of the trailing edge 10*b* passes, the hook 52 moves forward again from the plate removal path by its weight. When the hook 52 is restored, the plate removal operation accompanying the pivot motion of the upper plate cylinder 6A is stopped (the old plate 10 moves upward) substantially simultaneously, and the lower surface of the bent portion of the trailing edge 10*b* engages with the hook 52.

At the same time, as shown in FIG. 7A, the plate holding roller 135 separates from the upper plate cylinder 6A, and the rods of the air cylinders 150 move forward, so that the fulcrum rollers 155 move in the direction of the arrow E to press the trailing edge 10*b* of the old plate 10 removed from the upper plate cylinder 6A toward the upper plate cylinder 6A.

Subsequently, the rods of the air cylinders 140 move forward, so that the second old plate extracting lever 144 moves in the direction of the arrow F, to extract the leading edge 10*a* of the old plate 10 from the plate gripper 8A of the upper plate cylinder 6A. Then, the movable elements 53 of the air cylinders 51 (FIG. 9) move upward, and accordingly the hook 52 pulls up the old plate 10.

In this manner, the leading edge 10*a* of the old plate 10 pressed by the fulcrum rollers 155 is extracted from the plate gripper 8A of the upper plate cylinder 6A by the second old plate extracting lever 144, and after that the trailing edge 10*b* of the old plate 10 is pulled up by the hook 52. Therefore, the old plate 10 can be removed from the upper plate cylinder 6A reliably. The removed old plate 10 is recovered and held in the upper removed plate recovery section 30 on the frames 3 and 4 side. The old plate 10 recovered in the upper removed plate recovery section 30 is removed from it by the operator when the next plate feed operation is ended, as will be described later.

<Plate Feed Operation>

Upon actuation of an air cylinder (not shown), the plate holding roller 135 comes into contact opposite to the outer surface of the upper plate cylinder 6A, as shown in FIG. 6. Subsequently, the rods of the air cylinders 130 move backward, so that the plate removal/feed switching guide board 133 moves in the direction of the arrow E, and is positioned at the plate feed position. Subsequently, the rods of the air cylinders 85 are moved backward, in order to urge, between the two regulating members 74 and 75, the new plate 11 which is inserted from the elongated hole 73, is hung from the bars 108, and is in abutment against the first regulating member 74 with its one side edge.

As the rods of the fourth air cylinders 85 move backward, the support plates 82 pivot clockwise about the shaft 81 as the pivot center, as shown in FIG. 5A. Then, the oscillating rollers 83 also move in the direction of the arrow E of FIG. 5A, and the new plate 11 in contact with the oscillating rollers 83 is accommodated between the two regulating members 74 and 75. At this time, when the lower ends of the support plates 82 move in the direction of the arrow E, the levers 91 move in the direction of the arrow E through the shaft 90. Hence, the press rollers 92 press the leading edge 11*a* of the new plate 11 in the direction of the arrow E, so that it is positioned to correspond to the plate gripper 8A of the upper plate cylinder 6A.

Simultaneously, the air cylinder 77 (FIG. 4) is driven to move the second regulating member 75 toward the first regulating member 74, so that the two regulating members 74 and 75 position the new plate 11 in the widthwise direction. In this manner, since a mechanism for positioning the new plate 11 before being inserted in the upper plate cylinder 6A is provided in the upper loader 20, no guide unit for guiding the new plate 11 to between the upper loader 20 and upper plate cylinder 6A need be provided, unlike in the prior art. As a result, not only the apparatus can be downsized, but also the plate size increase can be coped with.

The movable elements 101 of the air cylinders 100 (FIG. 8) move downward, and accordingly the support members 107 move downward. Then, the leading edge 11*a* of the new plate 11 supported by the bars 108 abuts against the upper plate cylinder 6A and plate holding roller 135, so that the downward movement of the new plate 11 is stopped. After that, the support members 107 abut against the upper ends of the locking members 111. When the support members 107 move further downward, they pivot counterclockwise about the shafts 106 as the centers, and the bars 108 retreat from the plate accommodating section 78. Subsequently, the trailing edge 11*b* is pressed by the press portions 105*a*, so that the leading edge 11*a* can be inserted in the plate gripper 8A of the upper plate cylinder 6A.

In this state, when the upper plate cylinder 6A rotates in the forward direction indicated by an arrow in FIG. 6, the leading edge 11*a* of the new plate 11 abutting against the upper plate cylinder 6A and plate holding roller 135 is inserted into the plate gripper 8A by the plate holding roller 135. The upper plate cylinder 6A rotates through almost one turn, and accordingly the trailing edge 11*b* of the new plate 11 is inserted in the plate gripper 8A. When the reel rod of the plate gripper 8A is subsequently pivoted, the new plate 11 is mounted on the outer surface of the upper plate cylinder 6A. FIG. 19 shows a plate feed path Y of this case.

Figures 10D, 10E:
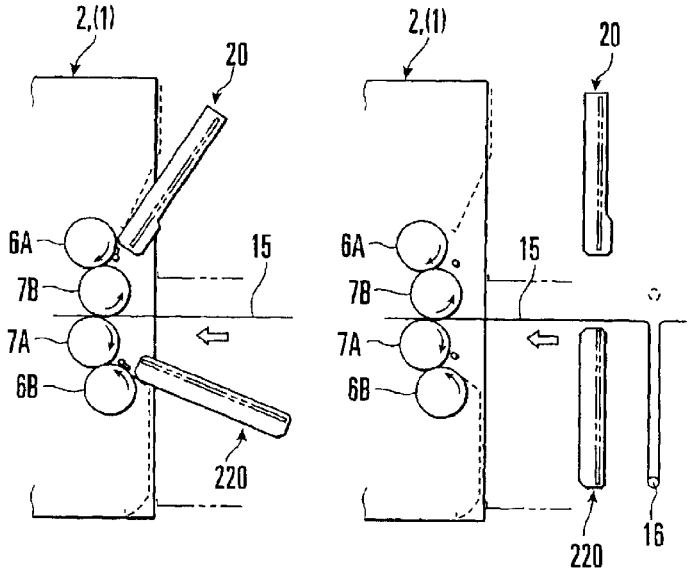

When mounting of the new plate 11 is ended, the rods 172 of the air cylinders 171 (FIG. 3) move backward, so that the upper loader 20 is set in the vertical state and positioned at the wait position. Subsequently, the air cylinder 26 (FIG. 2) is actuated to separate the upper loader 20 from the printing unit 1 and to position it at the wait position, as indicated by an alternate long and two short dashed line in FIG. 1. FIG. 10E shows this state. After that, the clutch between the driving mechanism of the printing unit 2 and the driving mechanism of the folding machine (not shown) is connected, as shown in FIG. 10E, to drive the driver of the printing press. Subsequently, the dancer roller 16 is moved upward, and the operator pulls the old plate 10 recovered in the upper removed plate recovery section 30 in the direction of the arrow B, to extract it to the work space 21.

In this manner, since the old plate 10 is recovered in the upper removed plate recovery section 30 provided to the frames 3 and 4, no unit for recovering the old plate 10 need be provided in the upper loader 20, and the upper loader 20 can be downsized in the sheet convey direction (direction of the arrows A–B). Since the upper loader 20 is moved to the retreat position, the work space of the upper removed plate recovery section 30 fixed to the frames 3 and 4 becomes large, and accordingly the old plate 10 can be removed from the upper loader 20 easily.

Since the upper loader 20 itself can be downsized and made lightweight, the air cylinders 171 and 26 for swinging and moving the upper loader 20 can be downsized, so that the apparatus can be downsized.

<Lower Plate Changing Device>

As shown in FIG. 1, the lower plate changing device 217 is constituted by a lower removed plate recovery section 230 fixed to the frames 3 and 4, and an lower loader 220 for guiding the old plate removed from the lower plate cylinder 6B to the lower removed plate recovery section 230 and feeding a new plate to the lower plate cylinder 6B.

The lower loader 220 is supported by a pair of outer frames 222 and 223 such that it can swing between a wait position (position indicated by a solid line in FIG. 1) where it is substantially perpendicular to the web convey direction (direction of the arrows A–B) and the plate feed position (position indicated by the alternate long and short dashed line in FIG. 1) where it inclines from the wait position and its upper end is close to the outer surface of the lower plate cylinder 6B. At the plate feed position, the new plate in the lower loader 220 can be fed to the lower plate cylinder 6B.

As shown in FIG. 2, the outer frames 222 and 223 stand upright on a pair of bases 224 to oppose each other. Rails 225 extending in the direction of the arrows A–B (FIG. 1), i.e., in the aligning direction of the printing unit 1 and a printing unit 2, are fixed to the frames 3 and 4, respectively, and the bases 224 are supported on the rails 225 to be movable in the direction of the arrows A–B. The bases 224 are moved in the direction of the arrows A–B by a rodless 10th air cylinder 226 fixed to the frame 3.

As the bases 224 move, the lower loader 220 can also move between the wait position and the retreat position indicated in FIG. 1 by the solid line and the alternate long and two short dashed line, respectively, through a work space 221 formed between the printing units 1 and 2. Under the work space 221, a step 227 is horizontally fixed to the frames 3 and 4 through support members (not shown).

<Lower Removed Plate Recovery Section>

Figure 11:
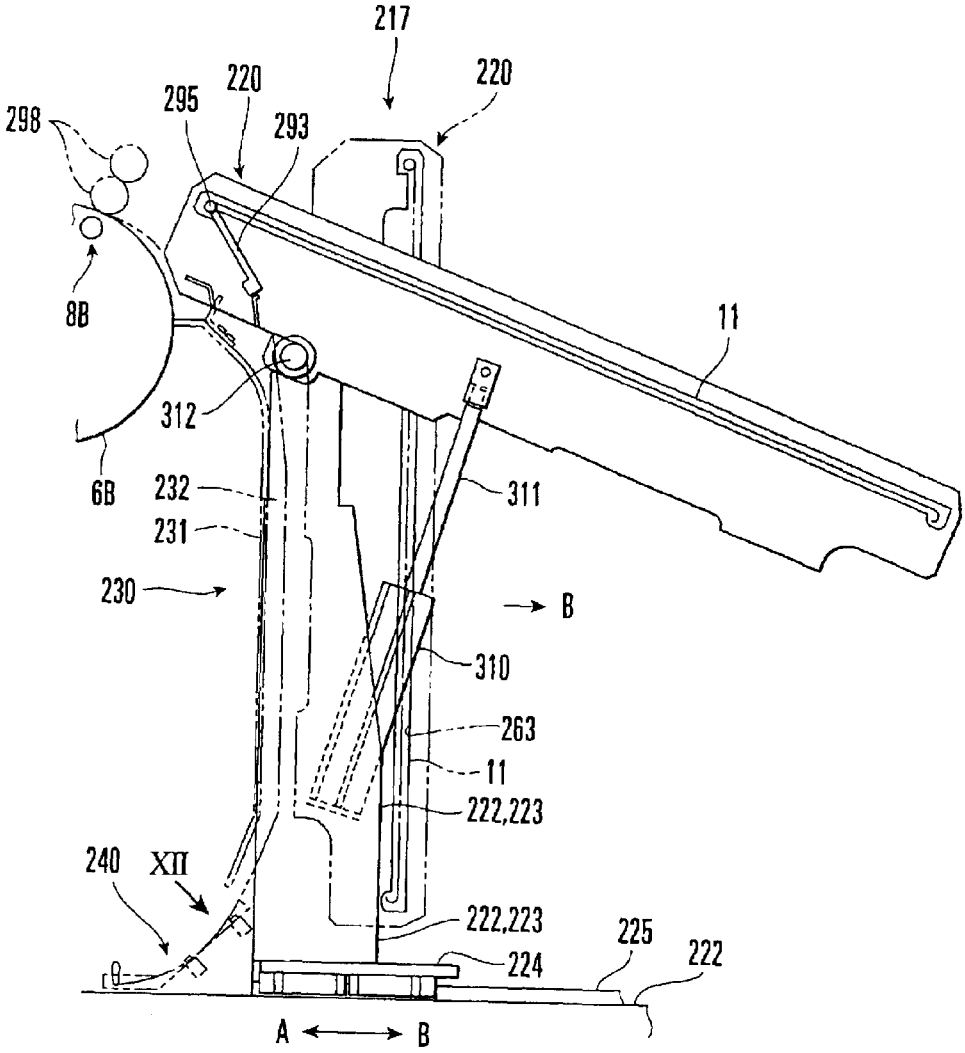
FIG. 11 is a view showing the schematic arrangement of the lower plate changing device of the plate changing apparatus shown in FIG. 1.

As shown in FIG. 11, the lower removed plate recovery section 230 has a flat plate-like removed plate guide board 231 fixed to the frames 3 and 4 and provided substantially vertically on the front surface of the printing unit. The upper end portion of the removed plate guide board 231 is curved, so that its upper end comes close to the outer surface of the lower plate cylinder 6B. A pair of removal preventive members 232 (only one is shown) are fixed to the outer frames 222 and 223 to oppose the two ends in the horizontal direction of the removed plate guide board 231.

In this arrangement, the old plate 10 removed from the lower plate cylinder 6B is guided downward between the removed plate guide board 231 and removal preventive members 232. The old plate 10 recovered in the removed plate recovery section 210 is removed in the direction indicated by an arrow B in FIG. 11.

<First Old Plate Extracting Mechanism>

Figure 12:
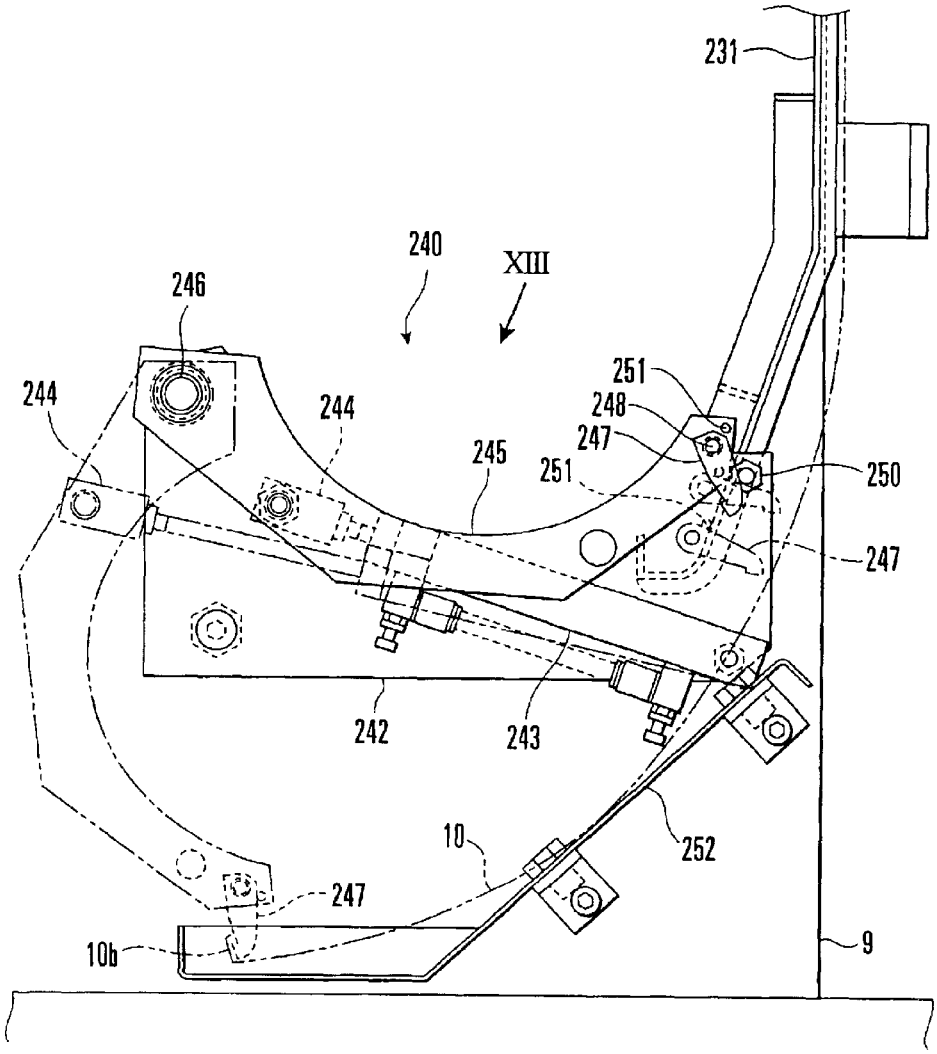
FIG. 12 is an enlarged view of a portion seen from the direction of an arrow XII of FIG. 11.

As shown in FIG. 12, a first plate extracting mechanism 240 is provided below the removed plate guide board 231 and removal preventive members 232, to extract the leading edge 10*a* of the old plate 10 from a gripper 8B of the lower plate cylinder 6B in plate removal.

Figure 13:
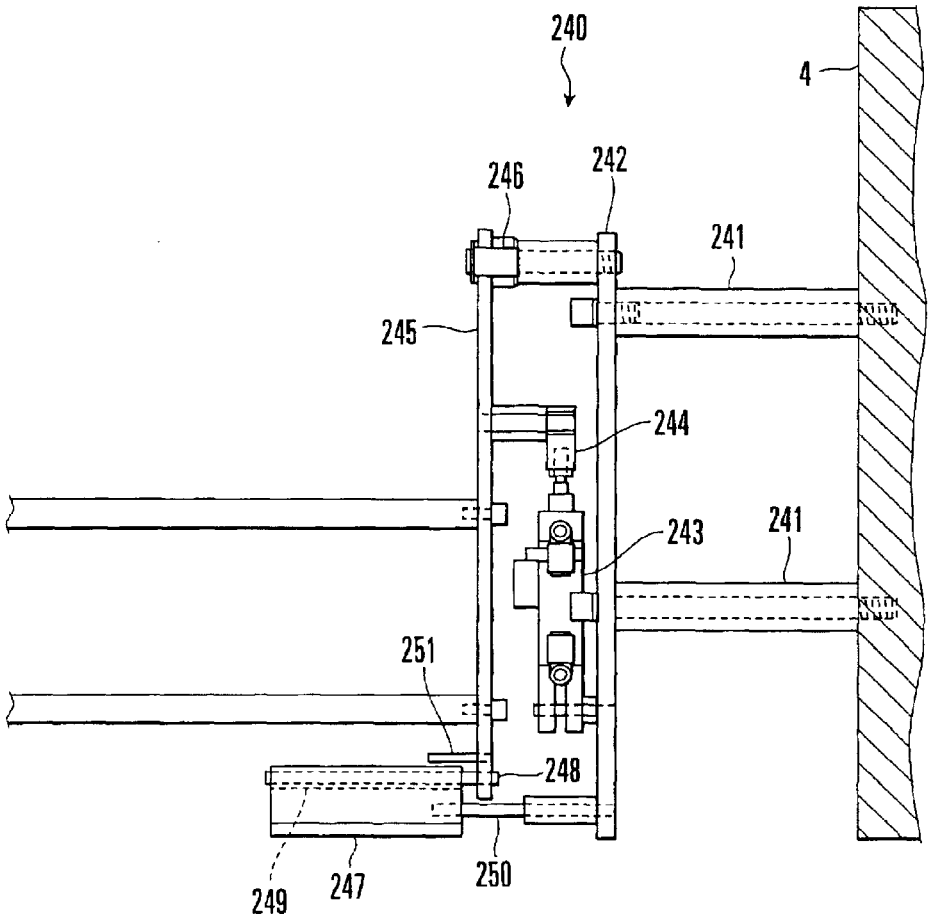
FIG. 13 is a view seen from the direction of an arrow XIII of FIG. 12.

As shown in FIG. 13, a base board 242 is fixed to two studs 241 projecting from the frame 4, and the cylinder end of an 11th air cylinder 243 is pivotally mounted on the base board 242. A rod 244 of the air cylinder 243 is pivotally mounted on a curved swing member 245, as shown in FIG. 12. The proximal end of the swing member 245 is supported by the base board 242 to be swingable about a shaft 246 as the center. A hook 247 is rotatably supported at the swing end of the swing member 245 through a shaft 248.

The hook 247 is biased by a torsion coil spring 249 (FIG. 13) wound on the shaft 248 to be pivotal counterclockwise in FIG. 12, and its pivot motion is regulated by a stopper pin 250 projecting from the base board 242. In this arrangement, in the initial state where the rod 244 of the air cylinder 243 has moved backward, the hook 247 pivots clockwise in FIG. 12 through the engagement with the stopper pin 250 against the torsion coil spring 249, and retreats from the removed plate guide board 231 as indicated by a solid line in FIG. 12. When the rod 244 of the air cylinder 243 moves slightly forward, the swing member 245 pivots clockwise slightly about the shaft 246 as the pivot center, so that the hook 247 separates from the stopper pin 250 while pivoting clockwise.

Hence, the hook 247 moves forward from the removed plate guide board 231 into the plate removal path by the biasing force of the torsion coil spring 249, and is held horizontally in the forward state by another stopper pin 251 standing upward from the swing member 245. A receiving guide board 252 fixed to the frames 3 and 4 holds the trailing edge 10*b* of the old plate 10 removed from the lower plate cylinder 6B.

In this arrangement, in plate removal, when the trailing edge 10*b* of the old plate 10 guided between the removed plate guide board 231 and removal preventive members 232 passes the hook 247, the rod 244 of the air cylinder 243 moves forward substantially simultaneously. Upon the forward movement of the rod 244, the hook 247 moves forward from the removed plate guide board 231 into the plate removal path, and the lower surface of the bent portion of the trailing edge 10*b* of the old plate 10 engages with the hook 247. When the rod 244 of the air cylinder 243 moves further forward, the swing member 245 rotates clockwise about the shaft 246 as the rotation center. Thus, the swing end of the swing member 245 moves along the receiving guide board 252, so that the old plate 10 with its trailing edge 10*b* engaging with the hook 247 is forcibly pulled downward.

<Lower Loader>

Figure 14:
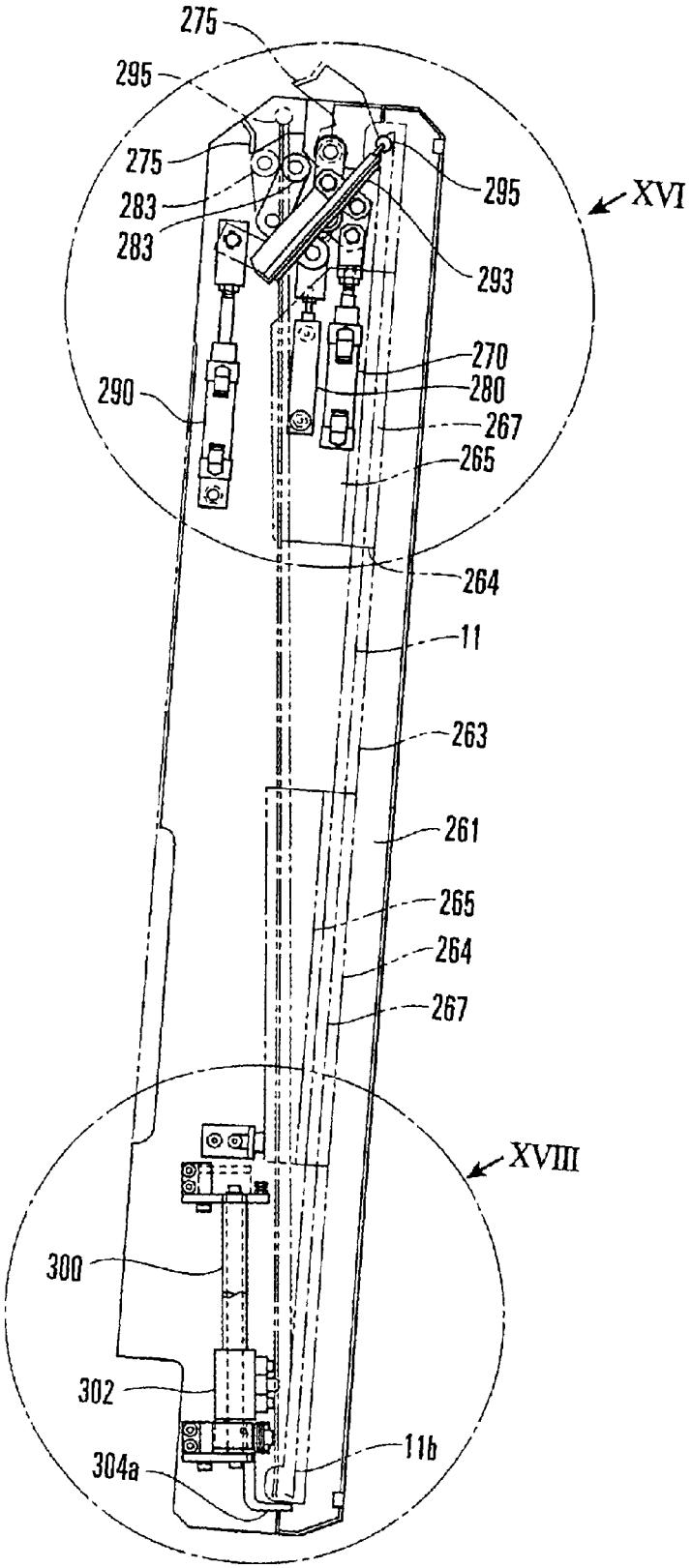
FIG. 14 is a view showing the schematic arrangement of the lower loader shown in FIG. 11.
Figure 15:
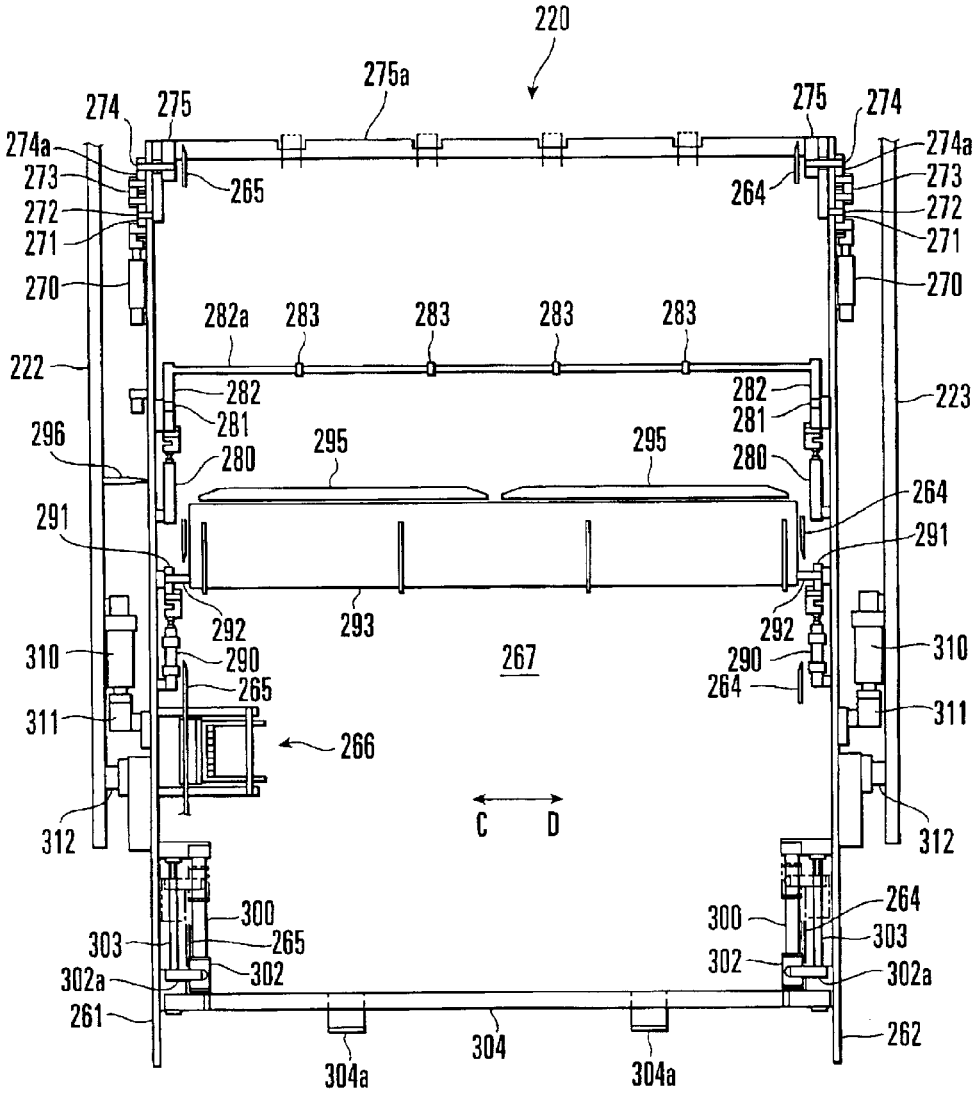
FIG. 15 is an exploded front view of the lower loader shown in FIG. 11.

The lower loader 220 has a pair of inner frames 261 and 262 arranged to oppose each other at a gap larger than the width of the new plate 11, as shown in FIG. 15. As shown in FIG. 14, the inner frame 261 has a slit-like elongated hole 263 along the longitudinal direction of the frame to allow insertion of the new plate 11. A flat plate-like first regulating member 264 is fixed inside the inner frame 262 to be parallel to it, as shown in FIG. 15. One side edge of the new plate 11 inserted from the elongated hole 263 abuts against the first regulating member 264.

A plate-like second regulating member 265 is provided inside the inner frame 261 to oppose the first regulating member 264. As shown in FIG. 14, the second regulating member 265 has an outer shape smaller than the first regulating member 264 by the elongated hole 263, so it will not regulate insertion of the new plate 11 inserted from the elongated hole 263. The second regulating member 265 can be slightly moved toward the first regulating member 264 (in the direction of an arrow D in FIG. 15) by a 12th air cylinder 266 fixed to the inner frame 261. Note that each of the first and second regulating members 264 and 265 is divided into two members, i.e., upper and lower regulating members, only part of which is shown in FIG. 15.

In this arrangement, the new plate 11 inserted from the elongated hole 263 abuts against the first regulating member 264 with its one side edge, and is moved by an oscillating mechanism (to be described later) (bars 295) in a direction perpendicular to a direction toward the surface of the new plate 11, and is stored in a plate storing section 267 formed between the two regulating members 264 and 265. After this, the air cylinder 266 moves the second regulating member 265 toward the first regulating member 264, so the two regulating members 264 and 265 position the new plate 11 in the widthwise direction.

<Second Old Plate Extracting Mechanism>

Figure 16:
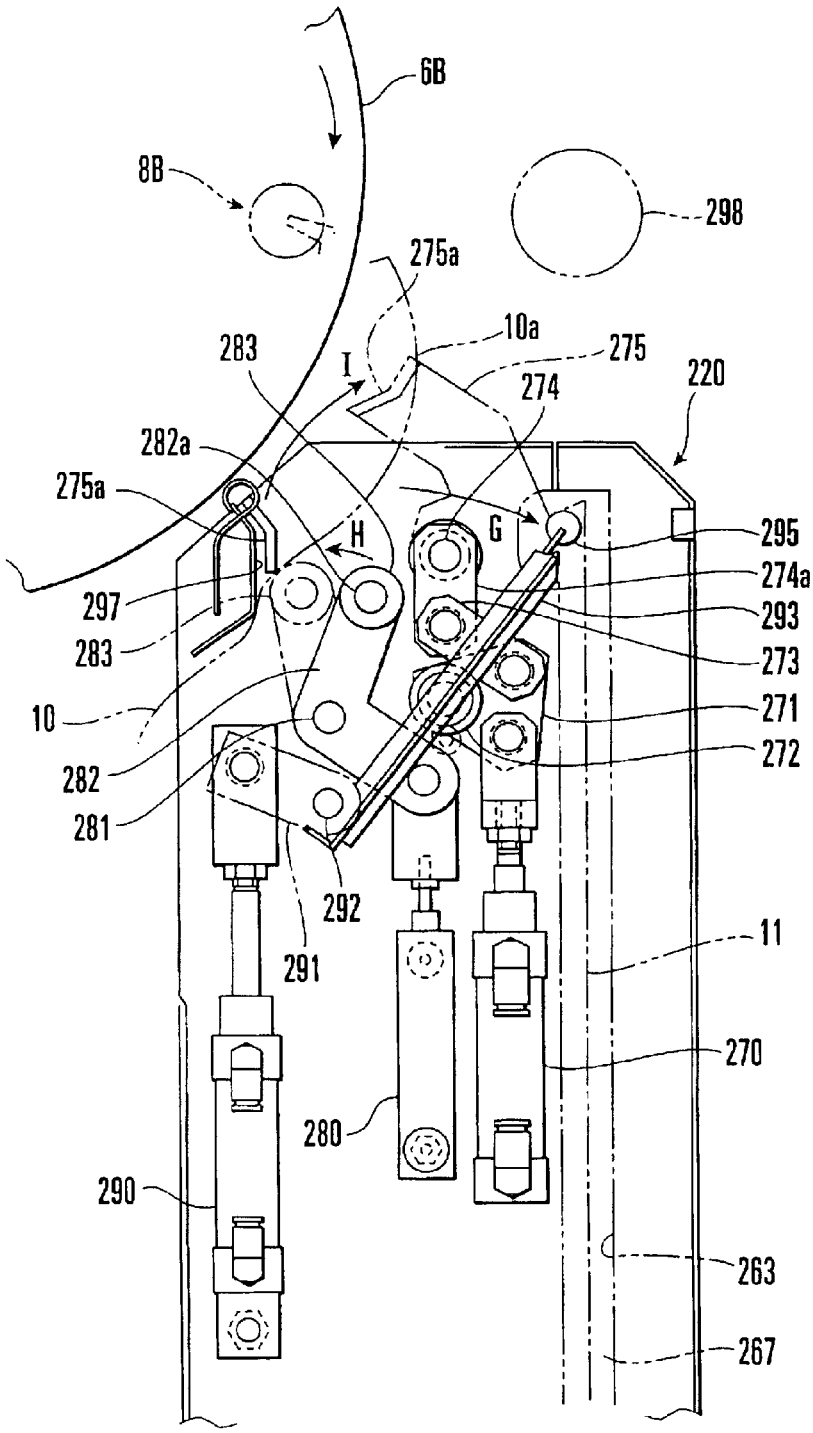
FIG. 16 is an enlarged view of the portion XVI of FIG. 14 to explain the plate removal operation of the lower plate changing device.

As shown in FIG. 15, a pair of 13th air cylinders 270 are fixed outside the inner frames 261 and 262. As shown in FIG. 16, the rod end of each air cylinder 270 is pivotally mounted on one end of a corresponding lever 271 having a triangular shape, when seen in the side view, and rotatably supported by a corresponding shaft 272 standing upward from the corresponding one of the inner frames 261 and 262.

The other end of the lever 271 and one end of a corresponding lever 274*a* are connected to each other by a link 273, and a pin 274 pivotally, axially supported by the inner frame 261 or 262 is axially mounted on the other end of the lever 274*a*. The proximal end of a second old plate extracting lever 275 is axially mounted on the pin 274. In this arrangement, when the rods of the air cylinders 270 move forward, the levers 271 pivot counterclockwise in FIG. 16 about the shafts 272 as the centers, respectively, and the shafts 274 pivot clockwise through the links 273 and levers 274*a*.

The second old plate extracting member 275 axially mounted on the shafts 274 pivots clockwise integrally with them about them as the pivot centers, and its swing end 275*a* moves from a position indicated by a solid line to a position indicated by an alternate long and two short dashed line. Thus, the swing end 275*a* of the second old plate extracting member 275 engages with the leading edge 10*a* of the old plate 10 during plate removal, so that the old plate 10 is forcibly extracted from the plate gripper 8B of the lower plate cylinder 6B.

As shown in FIG. 15, the cylinder ends of a pair of 14th air cylinders 280 are pivotally supported inside the inner frames 261 and 262. One end of each lever 282 is pivotally mounted on the rod end of the corresponding air cylinder 280, as shown in FIG. 16. The levers 282 are supported by the inner frames 261 and 262 to be pivotal about shafts 281 as pivot centers. The two ends of a support bar 282*a* extending between the inner frames 261 and 262 are fixed to the other end of one lever 282 and the other end of the other lever 282, as shown in FIG. 15. A plurality of fulcrum rollers 283 are rotatably supported by the support bar 282*a*.

In this arrangement, when the rods of the air cylinders 280 (FIG. 16) move forward, the levers 282 pivot counterclockwise about the shafts 281 as the pivot centers, and the fulcrum rollers 283 move in the direction of an arrow H. The fulcrum rollers 283 abut against the outer surface of the lower plate cylinder 6B, to press the leading edge 10*a* of the old plate 10 removed from the lower plate cylinder 6B toward the lower plate cylinder 6B. Thus, the old plate 10 is reliably extracted by the second old plate extracting lever 275 described above with the fulcrum rollers 283 as the fulcrum.

<Plate Removal/Feeding Switching Guide Board>

Figure 17:
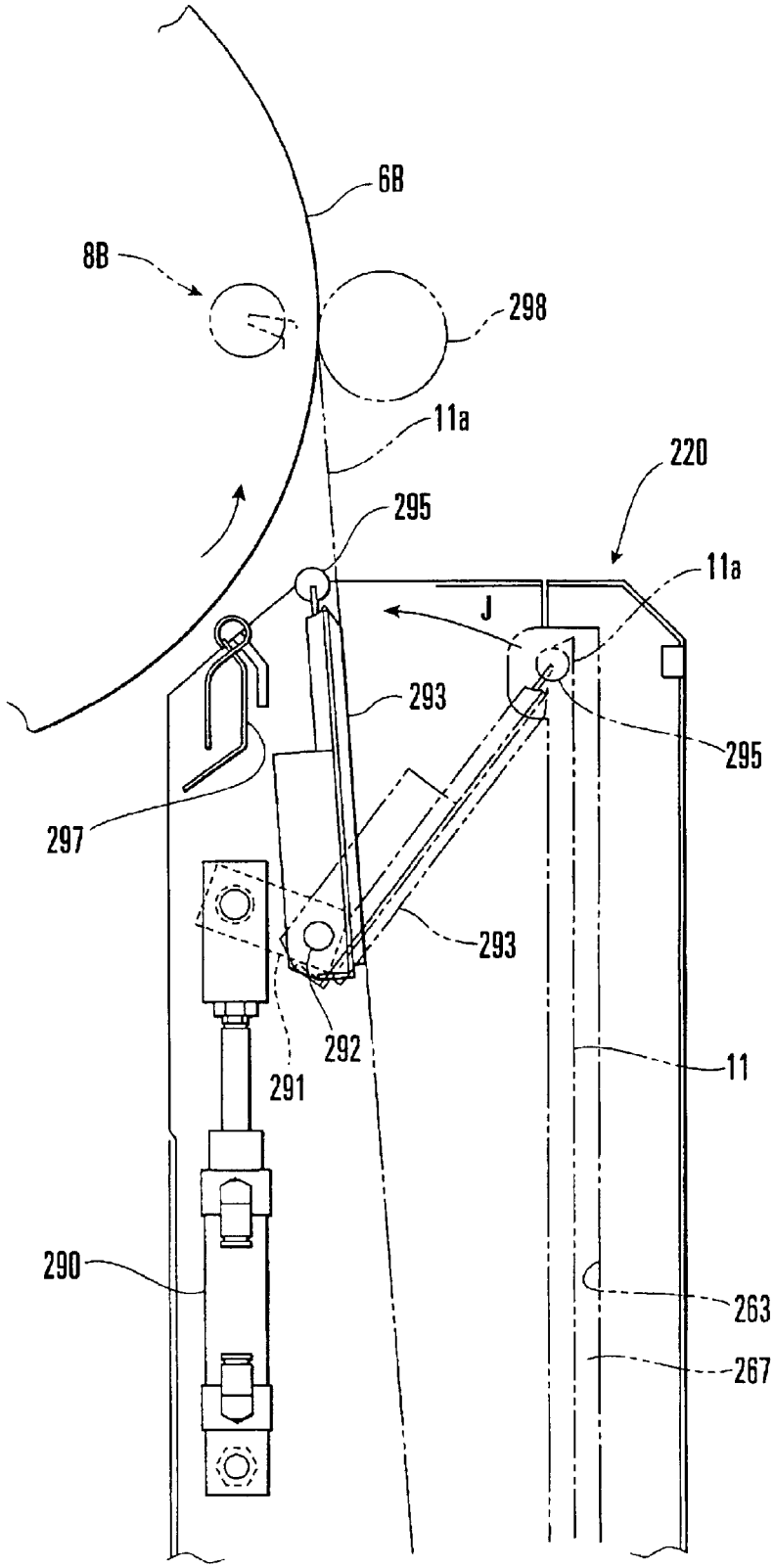
FIG. 17 is an enlarged view of the portion XVI of FIG. 14 to explain the plate feed operation of the lower plate changing device.

A pair of 15th air cylinders 290 with pivotally supported cylinder ends are provided inside the inner frames 261 and 262, as shown in FIG. 15. One end of each lever 291 is pivotally mounted on the rod end of the corresponding air cylinder 290, as shown in FIG. 17. Shafts 292 pivotally supported by the inner frames 261 and 262 are axially mounted on the other end of one lever 291 and the other end of the other lever 291, and the proximal end of the plate removal/feed switching guide board 293 is fixed to the shafts 292. The plate removal/feed switching guide board 293 extends between the inner frames 261 and 262, and its swing end swings about the shafts 292 as the rotation center.

In this arrangement, when the rods of the air cylinders 290 move forward, a plate removal/feed switching guide board 293 pivots clockwise in FIG. 17 about the shafts 292 as the rotation center, to move to the plate removal position indicated by an alternate long and two short dashed line. When the plate removal/feed switching guide board 293 is located at the plate removal position, it can guide the old plate 10 removed from the lower plate cylinder 6B to the removed plate recovery section 230. When the rods of the air cylinders 290 move backward, the plate removal/feed switching guide board 293 pivots counterclockwise (in the direction of an arrow J in FIG. 17) about the shafts 292 as the pivot center, to move the new plate 11 to the plate feed position (solid line) where the new plate 11 can be inserted in the lower plate cylinder 6B.

As shown in FIG. 17, a pair of bars 295 are fixed to the swing end of the plate removal/feed switching guide board 293, and extend between the inner frames 261 and 262, as shown in FIG. 15. When the plate removal/feed switching guide board 293 is positioned at the plate removal position (alternate long and two short dashed line) in FIG. 17, the bars 295 are located at the upper end of the elongated hole 263. When the plate removal/feed switching guide board 293 is located at the plate feed position (solid line), the bars 295 come close to the outer surface of the lower plate cylinder 6B, to move the old plate 10 hung from the bars 295 to an insertion position where the old plate 10 can be inserted into the plate gripper 8B of the lower plate cylinder 6B.

As shown in FIG. 15, a guide bar 296 is horizontally attached to the upper end of the outer frame 222 close to the inner frame 261 having the elongated hole 263. The guide bar 296 is provided at a position slightly higher than the bars 295. When inserting the new plate 11 into the lower loader 220 from the elongated hole 263, the bent portion of the leading edge 11*a* of the new plate 11 is temporarily placed on the guide bar 296. Subsequently, the bent portion of the leading edge 11*a* is smoothly and reliably guided from the guide bar 296 to the bars 295, and is supported by the bars 295.

The lower loader 220 has a removed plate guide 297 to oppose the plate removal/feed switching guide board 293, as shown in FIG. 17. The removed plate guide 297 guides the old plate 10 removed from the lower plate cylinder 6B to a removed plate recovery section 210. A plate press roller 298 can come close to and separate from the outer surface of the lower plate cylinder 6B by an air cylinder (not shown). When feeding a plate, the plate press roller 298 comes into contact opposite to the outer surface of the lower plate cylinder 6B, to insert the leading edge 11*a* and trailing edge 11*b* of the new plate 11 in the plate gripper 8B of the lower plate cylinder 6B, and to mount the new plate 11 in tight contact with the outer surface of the lower plate cylinder 6B.

<New Plate Pushout Mechanism>

A pair of rodless 16th air cylinders 300 are fixed inside the inner frames 261 and 262 through brackets 301, as shown in FIG. 15. The air cylinders 300 have movable elements 302 that move along guide bars 303, respectively. A movable rod 304 extending between the inner frames 261 and 262 has two ends connected to the movable elements 302 through connecting elements 302*a*. When the movable elements 302 guided by the guide bars 303 move, the movable rod 304 vertically moves integrally with the movable elements 302.

Figure 18:
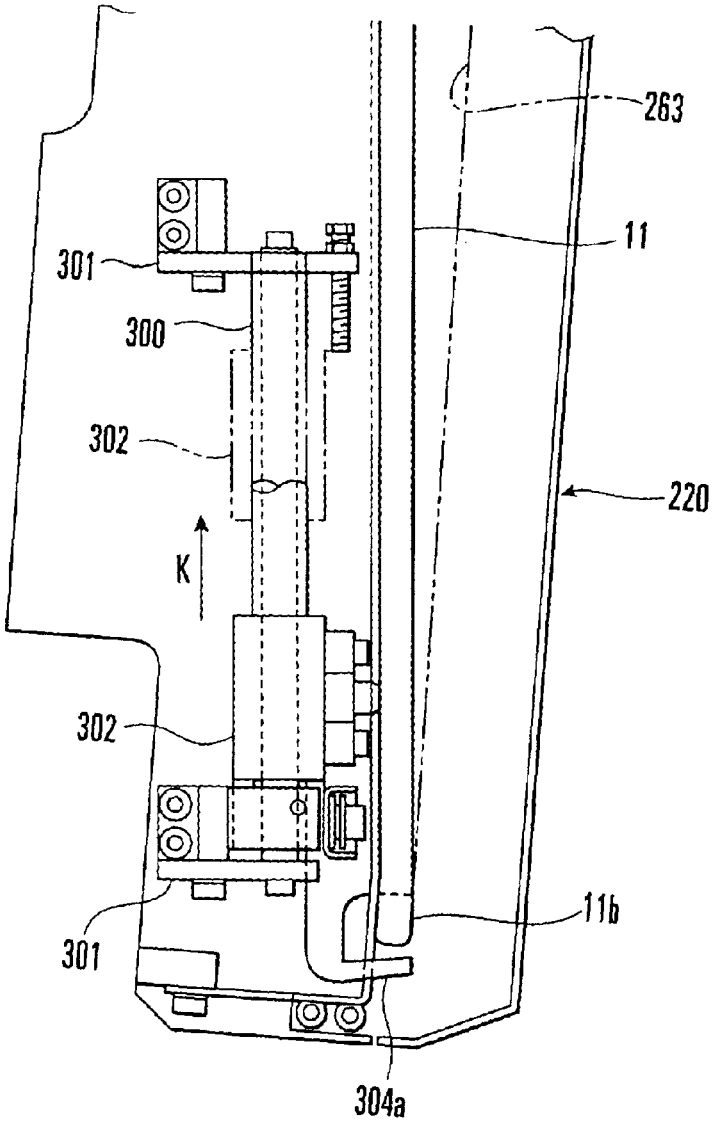
FIG. 18 is an enlarged view of the portion XVIII of FIG. 14.

The movable rod 304 has a pair of bent pressing portions 304*a*, as shown in FIG. 18. When the movable elements 302 are located at the lower end, the pressing portions 304*a* are inserted from the elongated hole 263, and are positioned immediately under the trailing edge 11*b* of the new plate 11 supported by the bars 295. In this state, the movable elements 302 of the air cylinders 300 move upward in the direction of an arrow K to the position indicated by an alternate long and two short dashed line, so that the pressing portions 304*a* abut against the trailing edge 11*b* of the new plate 11. Thus, the trailing edge 11*b* of the new plate 11 is caught by the pressing portions 304*a* and moves upward, to position the leading edge 11*a* of the new plate 11 to a position where the leading edge 11*a* can be inserted in the plate gripper 8B of the lower plate cylinder 6B.

<Swing Motion of Lower Loader>

The lower loader 220 is swingably supported by the outer frames 222 and 223 through support shafts 312, as shown in FIG. 11. The cylinder ends of a pair of 17th air cylinders 310 are pivotally supported inside the outer frames 222 and 223. The rod ends of rods 311 of the air cylinders 310 are respectively pivotally mounted on the inner frames 261 and 262, as shown in FIG. 15. In this arrangement, when the rods 311 of the air cylinders 310 move forward, the lower loader 220 inclines and is positioned at the plate feed position where its upper end is close to the lower plate cylinder 6B, as indicated by a solid line in FIG. 11. When the rods 311 of the air cylinders 310 move backward, the lower loader 220 is set in the vertical state, as indicated by an alternate long and short dashed line, and is positioned at the wait position.

<Plate Changing Operation of Lower Plate Cylinder>

First, the lower loader 220 is positioned at the wait position, as shown in FIG. 10A. More specifically, at the retreat position indicated by an alternate long and two short dashed line in FIG. 1, when the air cylinder 226 (FIG. 2) is actuated, the lower loader 220 moves in the direction of the arrow A from the position indicated by the alternate long and two short dashed line in FIG. 1, and is positioned at the wait position close to the printing unit 1 and indicated by the solid line.

In the upper loader 220 located at the wait position, the bent portion of the leading edge 11*a* of the new plate 11 is caught by the guide bar 296, as shown in FIG. 2, and the new plate 11 is moved in the direction of an arrow D so that it is inserted in the upper loader 220 from the elongated hole 263 of the inner frame 261. Subsequently, the bent portion of the leading edge 11*a* of the new plate 11 is transferred from the guide bar 296 to the bars 295 (FIG. 15), so that the new plate 11 is supported by the bars 295 by its weight.

Subsequently, the rods 311 of the air cylinders 310 move forward, and accordingly the lower loader 220 inclines and is positioned at the plate feed position, as shown in FIG. 11. Subsequently, the upper and lower blanket cylinders 7A and 7B are disengaged from each other, and the driver of the printing press is driven. As shown in FIG. 10B, the upper and lower plate cylinders 6A and 6B are rotated through almost one turn in the forward direction, to disconnect the clutch (not shown) between the driving mechanism of the printing unit 2 and the driving mechanism of the folding machine (not shown). At this time, the web 15 located between the printing unit 1 and the folding machine slacks by an amount substantially corresponding to the length of the circumference of the upper plate cylinder 6A. An air cylinder (not shown) is actuated to move the dancer roller 16 downward, thus removing the slack.

Subsequently, the rods of the air cylinders 290 move forward, so that the plate removal/feed switching guide board 293 moves in a direction of an arrow G, to be positioned at the plate removal position, as shown in FIG.

16. Then, an air cylinder (not shown) is actuated to bring the plate holding roller 298 into contact opposite to the outer surface of the lower plate cylinder 6B.

In this state, the reel rod of the plate gripper BB pivots, and the trailing edge 10*b* of the old plate 10 disengages from the lower plate cylinder 6B and pops up from the outer surface of the lower plate cylinder 6B. As shown in FIG. 10B, when the lower plate cylinder 6B rotates in the opposite direction (counterclockwise in FIG. 10B), the trailing edge 10*b* of the old plate 10 passes between the plate removal/feed switching guide board 293 and removed plate guide 297, and is guided to between the removed plate guide board 231 and removal preventive members 232, as shown in FIG. 11.

In this manner, since the removed plate guide board 297 for guiding the old plate 10 removed from the lower plate cylinder 6B and the plate removal/feed switching guide board 293 are provided to the distal end of the lower loader 220 which comes into contact opposite to the outer surface of the lower plate cylinder 6B, the old plate 10 can be reliably guided to the lower removed plate recovery section 230 through the lower loader 220.

Subsequently, when the lower plate cylinder 6B rotates in the opposite direction, the trailing edge 10*b* of the old plate 10 passes the hook 247, as shown in FIG. 12.

Subsequently, the plate press roller 298 separates from the outer surface of the plate cylinder 6B, as shown in FIG. 16. Also, the rods of the air cylinders 280 move forward, so that the fulcrum rollers 283 are moved in the direction of an arrow H, to press the leading edge 10*a* of the old plate 10 removed from the lower plate cylinder 6B toward the lower plate cylinder 6B. The rods of the air cylinders 270 then move forward, so that the swing end 275*a* of the second old plate extracting member 275 moves in the direction of an arrow I, to extract the leading edge 10*a* of the old plate 10 from the plate gripper 8B of the lower plate cylinder 6B. The rod of the air cylinder 243 moves forward, and accordingly the hook 247 engages with the bent portion of the trailing edge 10*b* of the old plate 10. When the hook 247 moves, the old plate 10 is pulled forcibly.

In this manner, the leading edge 10*a* of the old plate 10 pressed by the fulcrum rollers 283 is extracted from the plate gripper 8B of the lower plate cylinder 6B by the second old plate extracting member 275, and after that the trailing edge 10*b* of the old plate 10 is pulled up by the hook 247. Therefore, the old plate 10 can be removed from the lower plate cylinder 6B reliably. The removed old plate 10 is recovered and held in the lower removed plate recovery section 230 on the frames 3 and 4 side. In this manner, the old plate 10 recovered in the lower removed plate recovery section 230 is removed from it by the operator when the next plate feed operation is ended.

<Plate Feed Operation>

Upon actuation of an air cylinder (not shown), the plate holding roller 298 comes into contact opposite to the outer surface of the lower plate cylinder 6B, as shown in FIG. 17. Subsequently, the rods of the air cylinders 290 move backward, so that the plate removal/feed switching guide board 293 moves in the direction of an arrow J, and is positioned at the plate feed position. Subsequently, the new plate 11 inserted from the elongated hole 263 is positioned between the two regulating members 264 and 265, and the leading edge 11*a* of the new plate 11 moves in the direction of the arrow J, as shown in FIG. 17, and is positioned to correspond to the plate gripper 8B of the lower plate cylinder 6B.

Simultaneously, the air cylinder 266 is driven to move the second regulating member 265 in the direction of the arrow D (toward the first regulating member 264), so that the two regulating members 264 and 265 position the new plate 11 in the widthwise direction. In this manner, since a mechanism for positioning the new plate 11 before being mounted on the lower plate cylinder 6B is provided in the lower loader 220, no guide unit for guiding the new plate 11 to between the lower loader 220 and lower plate cylinder 6B need be provided, unlike in the prior art. As a result, the apparatus can be downsized, and the plate size increase can be coped with.

As shown in FIG. 18, the movable elements 302 of the air cylinders 300 move in the direction of the arrow K, and the pressing portions 304*a* also move in the direction of the arrow K. At this time, the pressing portions 304*a* abut against the trailing edge 11*b* of the new plate 11, to move the new plate 11 toward the lower plate cylinder 6B.

Thus, as shown in FIG. 17, the leading edge 11*a* of the new plate 11 is guided to the outer surface of the lower plate cylinder 6B by the plate removal/feed switching guide board 293. When the lower plate cylinder 6B rotates in the forward direction (clockwise in FIG. 10C) as shown in FIG. 10C, the leading edge 11*a* of the new plate 11 abutting against the plate press roller 298 is inserted in the plate gripper 8B by the plate press roller 298, as shown in FIG. 17.

When the lower plate cylinder 6B rotates substantially through one turn, the trailing edge 11*b* of the new plate 11 is inserted in the plate gripper 8B by the plate press roller 298, and after that the reel rod of the plate gripper 8B pivots to mount the new plate 11 on the outer surface of the lower plate cylinder 6B.

In this state shown in FIG. 10D wherein mounting of the new plate 11 is ended, the rods 311 of the air cylinders 310 (FIG. 11) move backward, so that the lower loader 220 is set in the vertical state and positioned at the wait position (alternate long and two short dashed line). Subsequently, the air cylinder 226 (FIG. 2) is actuated to separate the lower loader 220 from the printing unit 1 and to position it at the retreat position (position indicated by an alternate long and two short dashed line in FIG. 1). After that, the clutch between the driving mechanism of the printing unit 2 and the driving mechanism of the folding machine is connected, as shown in FIG. 10E, to drive the driver of the printing press. Subsequently, the dancer roller 16 moves upward, and then the operator pulls the old plate 10 recovered in the removed plate recovery section 210 in the direction of the arrow B, to extract it to the work space 221.

In this manner, since the old plate 10 is recovered in the lower removed plate recovery section 230 provided to the frames 3 and 4, no unit for recovering the old plate 10 need be provided in the lower loader 220, and the lower loader 220 can be downsized in the sheet convey direction (direction of the arrows A–B). Since the lower loader 220 can move to the retreat position, the work space of the lower removed plate recovery section 230 fixed to the frames 3 and 4 becomes large, and accordingly the old plate 10 can be removed from the lower removed plate recovery section 230 easily.

Since the lower loader 220 itself can be downsized and made lightweight, the air cylinders 310 and 226 for swinging and moving the lower loader 220 can be downsized, so that the apparatus can be downsized.

In this embodiment, a printing press for printing on the web 15 has been described. The present invention can also be applied to a sheet-fed rotary printing press for printing on a sheet.

As has been described above, according to the present invention, since a mechanism for positioning a new plate before being fed is provided in the loader, no guide unit for a new plate need be provided between the loader and the plate cylinder. Thus, the apparatus can be downsized, and the plate size increase can be coped with.

What is claimed is:

1. A plate inserting apparatus comprising:

a loader for holding a new plate inserted in a lateral direction and feeding the new plate to a plate cylinder;

a first regulating member for regulating a position of one side edge of the new plate inserted in said loader;

a second regulating member for regulating a position of the other side edge of the new plate inserted in said loader, thus positioning the new plate in a widthwise direction in cooperation with said first regulating member; and first moving means for moving the new plate inserted in said loader in a direction substantially perpendicular to a plate surface, thus accommodating the new plate between said first and second regulating members.

2. An apparatus according to claim 1, wherein said second regulating member is supported in said loader to be movable in a direction to come close to and separate from said first regulating member.

3. An apparatus according to claim 2, further comprising second moving means for moving said second regulating member toward said first regulating member.

4. An apparatus according to claim 1, further comprising a bar which extends in an inserting direction of the new plate and engages with a bent portion at one end of the new plate inserted in said loader.

5. An apparatus according to claim 4, wherein the new plate supported by said bar is moved by said first moving means as said bar moves.

6. An apparatus according to claim 4, wherein the new plate supported by said bar is moved by said first moving means about said bar as a swing center.

7. An apparatus according to claim 6, wherein said apparatus further comprises a plate removal/feed switching guide which is supported at a distal end of said loader and which is switched between plate removal operation and plate feeding operation, and said bar is supported by said plate removal/feed switching guide.

8. An apparatus according to claim 4, further comprising a guide bar provided outside said loader to guide the bent portion of one end of the new plate to said bar.

9. An apparatus according to claim 8, wherein said guide bar is arranged above said bar.

10. An apparatus according to claim 8, further comprising disengaging means for moving said bar in a direction to come close to said plate cylinder, thus disengaging said bar and the new plate accommodated in said plate accommodating section from each other.

11. An apparatus according to claim 1, wherein said first moving means comprises a new plate moving member for abutting against the plate surface of the new plate, thus moving the new plate.

12. An apparatus according to claim 11, wherein said new plate moving member comprises a support plate supported to be swingable, and a plurality of rollers supported by said support plate to touch the plate surface of the new plate, and said first moving means comprises a driving unit for swinging said support plate.

13. An apparatus according to claim 1, wherein said second regulating member has a tapered surface on an inner side thereof against which the other side edge of the new plate abuts.

14. An apparatus according to claim 1, wherein said loader has a slit in a side surface thereof for allowing insertion of the new plate, and said second regulating member is provided at such a position not regulating insertion of the new plate into said loader.

15. An apparatus according to claim 14, wherein said second regulating member is formed smaller than said first regulating member by an amount corresponding to a width of the slit in a direction toward the plate surface of the new plate.

* * * * *